US005230227A

United States Patent [19]

Kondoh et al.

[11] Patent Number: 5,230,227

[45] Date of Patent: Jul. 27, 1993

[54] WASHING MACHINE

[75] Inventors: Shinji Kondoh, Kawanishi; Shuji Abe, Toyonaka; Haruo Terai, Suita, all of Japan

[73] Assignee: Matsushita Electric Industrial Co., Ltd., Kadoma, Japan

[21] Appl. No.: 684,951

[22] PCT Filed: Sep. 6, 1990

[86] PCT No.: PCT/JP90/01136

§ 371 Date: Jun. 26, 1991

§ 102(e) Date: Jun. 26, 1991

[87] PCT Pub. No.: WO91/03589

PCT Pub. Date: Mar. 21, 1991

[30] Foreign Application Priority Data

| | | | |
|---|---|---|---|
| Sep. 7, 1989 | [JP] | Japan | 1-232502 |
| Nov. 16, 1989 | [JP] | Japan | 1-298213 |
| Nov. 16, 1989 | [JP] | Japan | 1-298214 |
| Nov. 16, 1989 | [JP] | Japan | 1-298228 |
| Nov. 16, 1989 | [JP] | Japan | 1-298229 |
| Dec. 7, 1989 | [JP] | Japan | 1-318040 |

[51] Int. Cl.[5] ..... D06F 33/02

[52] U.S. Cl. ..... 68/12.02

[58] Field of Search ..... 68/12.02, 12.04, 12.05

[56] References Cited

U.S. PATENT DOCUMENTS 4,222,250 9/1980 Torita .

FOREIGN PATENT DOCUMENTS

| | | |
|---|---|---|
| 2485576 | 12/1981 | France . |
| 62-383 | 1/1987 | Japan . |
| 62-197099 | 8/1987 | Japan . |
| 63-54400 | 10/1988 | Japan . |
| 1-274797 | 11/1989 | Japan . |
| 2-23995 | 1/1990 | Japan . |
| 2-107296 | 4/1990 | Japan . |

*Primary Examiner*—Philip R. Coe

*Attorney, Agent, or Firm*—Cushman, Darby & Cushman

[57] ABSTRACT

The washing machine controller has a cleaning sensor, a variation detecting device, a time counter, a washing time inference unit and a control unit. The cleaning sensor detects a turbidity of water in a washing tub of the washing machine. The variation detecting device detects a variation of the detected turbidity. The time counter measures a saturation time period, from a start of washing operation to a time point of saturation. The time point of saturation is determined when the detected turbidity becomes less than a predetermined value. The washing time inference unit uses a fuzzy inference operation to make an inference as to an additional washing time necessary for the cleaning operation after the time point of saturation based on the saturation time period and the detected turbidity. The fuzzy inference operation incorporates human experience in to the washing time determination process. The control unit stops the washing operation when the additional washing time expires.

7 Claims, 34 Drawing Sheets

Washing time

| Light-transmittance / Saturation time | High | Normal | Low |
|---|---|---|---|
| Short | Very short | Short | Long |
| Long | Short | Long | Very long |

Saturation timemembership function

Light-transmittance membership function

Washing time membership function

Fig. 8(a)
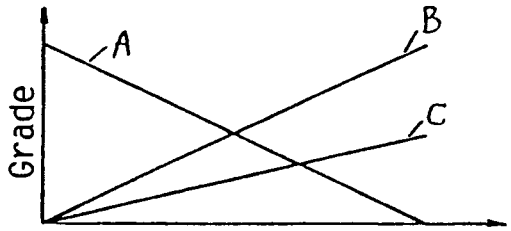
Fig. 8(b)
| Assumption part | A | B | C |
|---|---|---|---|
| Conclusion part | 10 | 0 | 0 |
Fig. 9
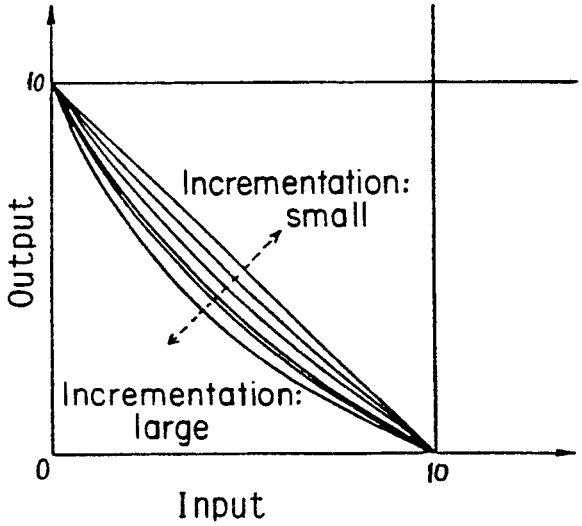
Fig. 10
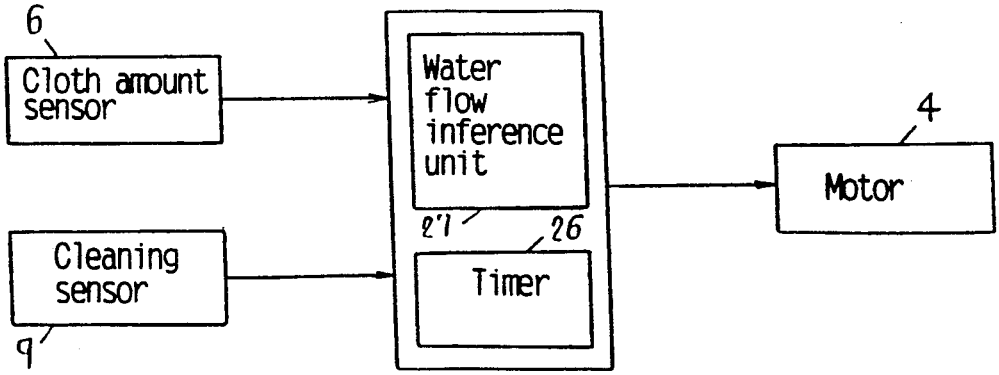

Fuzzy reasoning 1 (Correction value)

| Lapse time \ Light-transmittance change rate | Small | Large |
|---|---|---|
| Short | (Fairly strong)<br>Q11 R11<br>Q21 R12<br>Q31 R13 | (Fairly weak)<br>Q12 R12<br>Q22 R22<br>Q32 R32 |
| Long | (Fairly weak)<br>Q13 R13<br>Q23 R23<br>Q33 R33 | (Fairly strong)<br>Q14 R14<br>Q24 R24<br>Q34 R34 |

Fuzzy inference 2

(Strength of water flow)

| Cloth amount | Few | Much |
|---|---|---|
| | (Weak)<br>f1(x)<br>f3(x) | (Strong)<br>f2(x)<br>f4(x) |

| | | | | |
|---|---|---|---|---|
| Cloth amount | Very few | Few | Much | Very much |
| Water level | Very low | Low | High | Very high |

Fig. 31
| Cloth amount / Wash | Fairly few | Normal | Fairly much |
|---|---|---|---|
| Lingerie | Normal | Fairly much | Very much |
| Cutter shirt | Fairly few | Normal | Rather much |
| Jeans | Very few | Fairly few | Normal |
Fig. 32(a)
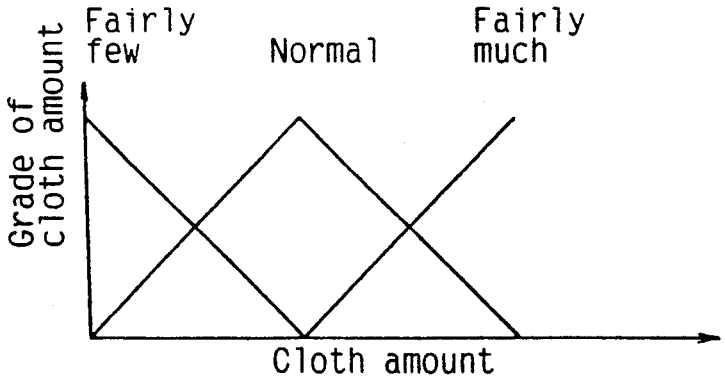
Fig. 32(b)
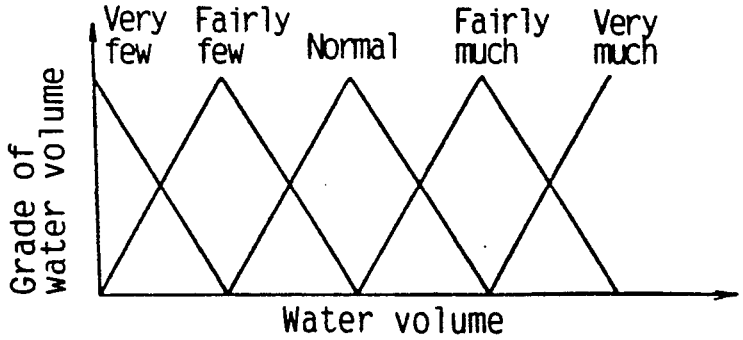

Correction value

| Water volume / Extent of soiling | Fairly few | Normal | Fairly much |
|---|---|---|---|
| Fairly few | Very few | Slightly few | Slightly much |
| Normal | Fairly few | Normal | Fairly much |
| Fairly much | Slightly few | Slightly much | Very much |

Water level

| Cloth amount / Correction value | Few | Much |
|---|---|---|
| Few | Low | High |
| Much | Normal | Very high |

| Cloth amount / Washing mode | Few | Normal | Much |
|---|---|---|---|
| Weak | Very weak | Slightly weak | Slightly strong |
| Normal | Weak | Normal | Strong |
| Strong | Slightly weak | Slightly strong | Very strong |

Washing time

| Cloth amount | Light-transmittance | Saturation time | Extent of soiling | Washing time |
|---|---|---|---|---|
| Few | Small | Short | Few | Fairly short |
| | | | Normal | Slightly short |
| | | | Much | Normal |
| | | Long | Few | Slightly short |
| | | | Normal | Normal |
| | | | Much | Slightly long |
| | Large | Short | Few | Very short |
| | | | Normal | Fairly short |
| | | | Much | Fairly short |
| | | Long | Few | Fairly short |
| | | | Normal | Fairly short |
| | | | Much | Slightly short |
| Much | Small | Short | Few | Normal |
| | | | Normal | Slightly long |
| | | | Much | Long |
| | | Long | Few | Slightly long |
| | | | Normal | Fairly long |
| | | | Much | Very long |
| | Large | Short | Few | Short |
| | | | Normal | Slightly short |
| | | | Much | Normal |
| | | Long | Few | Slightly short |
| | | | Normal | Normal |
| | | | Much | Slightly long |

Fig. 44

Fig. 49

Water flow

| Cloth amount | Wear level | Washing mode | Water flow |
|---|---|---|---|
| Few | Low | Weak | Very weak |
| | | Normal | Weak |
| | | Strong | Slightly strong |
| | High | Weak | Slightly weak |
| | | Normal | Normal |
| | | Strong | Strong |
| Much | Low | Weak | Slightly weak |
| | | Normal | Normal |
| | | Strong | Slightly strong |
| | High | Weak | Slightly strong |
| | | Normal | Strong |
| | | Strong | Very strong |

WASHING MACHINE

FIELD OF THE INVENTION

The present invention relates to a washing machine performing washing control utilizing fuzzy inference.

BACKGROUND OF THE INVENTION

Heretofore, a washing machine that automatically determined various washing conditions using various kinds of sensors.

For example, there exists a washing machine which is equipped with a cleaning sensor for detecting the degree of deterioration of washing water, and determines the cleaning time according to the information from this cleaning sensor. There also exists a washing machine which is equipped with a cloth amount sensor which detects the laundry volume, determines the water level, and the water flow at the time of cleaning as well as rinse according to the information from this sensor. Furthermore, there exists a washing machine which is equipped with, in addition to the above-mentioned cleaning sensor and cloth amount sensor, a manual-setting input part for manually setting various washing conditions such as laundry volume, water flow, and washing time. In the washing machines equipped with these various kinds of sensors as well as the manual-setting input part, although the various washing conditions such as washing time or the water level were determined automatically, the determination of washing conditions in accordance with the information from various sensors and the manual-setting input part were done independently.

The prior art washing machines determine washing time based one the information from the cleaning sensor. Then the relation between the degree of deterioration of washing water and the washing time is expressed by a simple mathematical formula such that the setting is done in a manner that when the degree of deterioration of washing water is great the cleaning time is made long. Then based on this mathematical formula the washing time is determined automatically. As a result, the washing time could not be determined based on a relation between the washing time and the degree of deterioration of washing water gained from the experience of a user, bringing about a great difference from the washing time which was intended by the user. This gave a problem that the most suitable washing time based on the user's experience could not be set.

Neither washing water flow nor rinse water flow can be determined uniquely by the cloth amount. These flows should be determined when considering the degree of soiling of the laundry (amount and type of soiling of the laundry). In washing machines of prior art, however, since the water flow is determined only by the information from the cloth amount sensor and the degree of soiling of the laundry is not taken into account for the determination of the water flow, there has been a problem that careful washing and rinse taking every factor into account could not be done.

Although the most suitable water level should be determined by mass, type, volume and other factors of the laundry, in the washing machines of prior art, the water level was determined only by the information from the cloth amount sensor, there has been a problem that the water level was not sufficiently determined.

Furthermore, in the washing machines of prior art, since the determination of the washing condition and the determination of the washing condition through the manual-setting input part are independent of each other, the washing condition cannot be determined by a combination of the information from the manual-setting input part, which is the information on the sort of laundry that is difficult to detect using sensors and the detected values from the various sensors. Hence there has been a problem that it was very difficult to determine the various washing conditions corresponding to laundry of a mixture of multiple sorts.

There has also been a problem that, by adding the information through the manual-setting input part given manually by a user to the determination of the washing condition obtained from the detected values output by the various sensors, "the most suitable washing" according to the various sensors and "washing according to the user's taste" could not be realized at the same time.

SUMMARY OF THE INVENTION

The object of the present invention is to provide a washing machine controller which (1) can determine the most suitable washing time based on a user's experience, (2) can determine the washing water flow as well as the rinse water flow by also taking the degree of soiling of laundry into account, (3) can determine the most suitable water level by also referring to the detected value from a water level sensor provided in addition to a cloth amount sensor, (4) can determine various washing conditions corresponding to laundry of the mixture of a multiple sorts, and (5) can determine "the most suitable washing" according to the various sensors and "washing according to the user's taste" according to manual input for realization at the same time. Furthermore, the washing machine of the present invention can determine, first, the water level reflecting the user's taste, second, the water flow reflecting the user's taste, third, the washing time as well as the rinse time reflecting the user's taste, and fourth, various washing conditions also reflecting user's taste.

In order to achieve the above-mentioned first objective, the present invention has a cleaning sensor for detecting the degree of deterioration of washing water and a washing time inference unit which determines the washing time using fuzzy inference by inputting thereinto the time until which the detected value from the cleaning sensor reaches saturation as well as the detected value itself at the time thereof.

The washing time inference unit incorporates a user's know-how into the determination of the washing time, which depends on the soiling of laundry from the detected value of the cleaning sensor, using fuzzy inference to determine the most suitable washing time.

In order to achieve the above-mentioned second objective, the present invention has a cleaning sensor for detecting the degree of deterioration of washing water, a cloth amount sensor for detecting the quantity of laundry, a timer for measuring the washing time and the rinse time, and a water flow inference unit which receives the detected values of these cleaning sensor, the cloth amount sensor and the timer value from the timer as its input to make a fuzzy inference on the washing water flow and the rinse water flow.

Based on the degree of cleaning-up of the soiling of laundry detected by the cleaning sensor, the cloth amount detected by the cloth amount sensor, and the washing time and the rinse time detected by the timer, the washing water flow and rinse water flow are determined by the water flow inference unit.

By affording the water flow inference unit the water flow control know-how which users generally know from their experience, an appropriate determination of the water flow allowing the inclusion of a touch of humanity can be attained.

In order to achieve the above-mentioned third objective, the present invention has a cloth amount sensor for detecting the quantity of laundry, a water level inference unit for making the inference on the predetermined water level, a water level sensor for detecting the water level, and a water-supply valve control means for controlling a water-supply valve according to a comparison between the detected value of the water level sensor and the predetermined water supply level determined by the inference of the above-mentioned water level inference unit.

The predetermined water-supply water level is determined by the water level inference unit from the detected value of the cloth amount sensor immediately before the washing and rinse processes. Then the water supply is started and the water level rising rate is determined from the detecting value of the water level sensor. Further the water-supply valve control means controls the water-supply valve by comparison the above-mentioned predetermined water-supply water level and the water level rising rate, thereby the most suitable water level determination becomes possible.

In order to achieve the above-mentioned fourth objective, the present invention has a manual-setting input part for accepting the manual input by an operator on a sort and the quantity of laundry, the cloth amount sensor for detecting the cloth amount, the cleaning sensor for detecting the degree of soiling, a washing condition inference unit which receives information from the above-mentioned manual-setting input part and the detecting value of the cloth amount sensor and the cleaning sensor as its input and determines therefrom various washing conditions. A control part controls a motor, the water supply valve, and a drain valve according to the washing condition determined by the above-mentioned washing condition inference unit.

Since the fuzzy inference is made on the determination of various washing conditions with simultaneous consideration of multifold information such the sort and the quantity of laundry from the manual-setting input part as well as the detecting values of the cloth amount sensor and the cleaning sensor, the can control part controls the motor, water supply valve, and the drain valve to obtain an appropriate washing.

Furthermore, in order to achieve the above-mentioned fifth objective, the first means of the present invention has a manual-setting input part for accepting the manual input by the operator on the water volume and the extent of soiling, a cloth amount sensor for detecting the cloth amount, and a water volume determination means which receives the detected value of the above-mentioned cloth amount sensor as well as the information from the above-mentioned manual-setting input part as its input and determines the washing water level and the rinse water level by the fuzzy inference.

A second means has a manual-setting input part for accepting the manual input by the operator on the mode of washing, a cloth amount sensor for detecting the cloth amount, and a water flow determination means which receives the detected value of the above-mentioned mentioned cloth amount sensor as well as information obtained from the above-mentioned manual-setting input part as its input and determines the washing water flow and the rinse water flow by the fuzzy inference.

A third means has a manual-setting input part for accepting the manual input by the operator on the degree of soiling, a cloth amount sensor for detecting the cloth amount, a cleaning sensor for detecting the deterioration, and a washing time determination means which receives the detected value of the above-mentioned various sensors as well as information obtained from the above-mentioned manual-setting input part as its input and determines the washing time and the rinse time by the fuzzy inference.

A fourth means has a manual-setting input part for accepting the manual input by the operator on the water volume, an extent of soiling, and a mode of washing; a cloth amount sensor for detecting the cloth amount; a cleaning sensor for detecting the deterioration; and a fuzzy inference unit which receives the detected values of various sensors and the information obtained from the above-mentioned manual-setting input part as its input and determines various washing conditions of water level, washing time, rinse time, washing water flow, rinse water flow, and others.

In accordance with the above first means, although normally the adequate water level is determines by making the fuzzy inference by the water level determination means using the detected value of the cloth amount sensor, the water level is determined to reflect a user's taste in the adequate water level range according to the information obtained by the manual-setting input part; which is for accepting the manual input by the user on the water volume and the extent of soiling.

In accordance with the above second means, although normally the adequate water level is determined by making the fuzzy inference by the water level determination means using the detected value of the cloth amount sensor, the water flow is determined to reflect a user's taste in the adequate water flow range according to the information obtained by the manual-setting input part; which is for accepting the manual input by the user on the mode of washing.

In accordance with the above third means, although normally the adequate washing time as well as the rinse time are determined by making the fuzzy inference by the water level determination means using the detected value of the cloth amount sensor and the cleaning sensor, the washing time as well as the rinse time are determined to reflect a user's taste in the adequate time range according to the information obtained by the manual-setting input part; which is for accepting the manual input by the user on the extent of soiling.

In accordance with the above fourth means, an adequate water level is determined from the detected value of the cloth amount sensor, and the washing water flow and the rinse water flow are determined from this detected value and the above-mentioned adequate water level. The washing time is determined from the detected value of the cleaning sensor and the above-mentioned adequate water level and water flow. Although the above-mentioned various washing conditions are determined using a multiple-stage inference by the fuzzy inference unit, those various washing conditions are determined to reflect a user's taste in the adequate range of various washing condition according to the informations obtained by the manual-setting input part;

which is for accepting the manual input by the user on water volume, extent of soiling, and mode of washing.

BRIEF DESCRIPTION OF THE DRAWINGS

FIG. 8(*a*) is a graph of a weighted monotonous type membership function.

FIG. 8(*b*) is a drawing showing a fuzzy inference rule.

FIG. 9 is an input-output characteristic curve in the fuzzy inference shown in FIG. 8.

FIG. 10 is a block diagram of a washing machine according to a second embodiment of the present invention.

FIG. 31 is a inference rule of a washing condition inference unit of the fourth embodiment.

FIGS. 32(*a*) and 32(*b*) are graphs showing membership functions of the cloth amount and water volume, respectively.

FIGS. 35(*a*) and 35(*b*) are drawings showing a inference rule for determining an amount of water volume correction and the water level.

FIG. 44 is a drawing showing a inference rule for determining the washing time.

FIG. 49 is a drawing showing a inference rule for determining the water flow.

DETAILED DESCRIPTION OF THE PREFERRED EMBODIMENTS

Explanation is given on the first embodiment of the present invention referring to FIG. 1 through FIG. 9.

Figure 1:
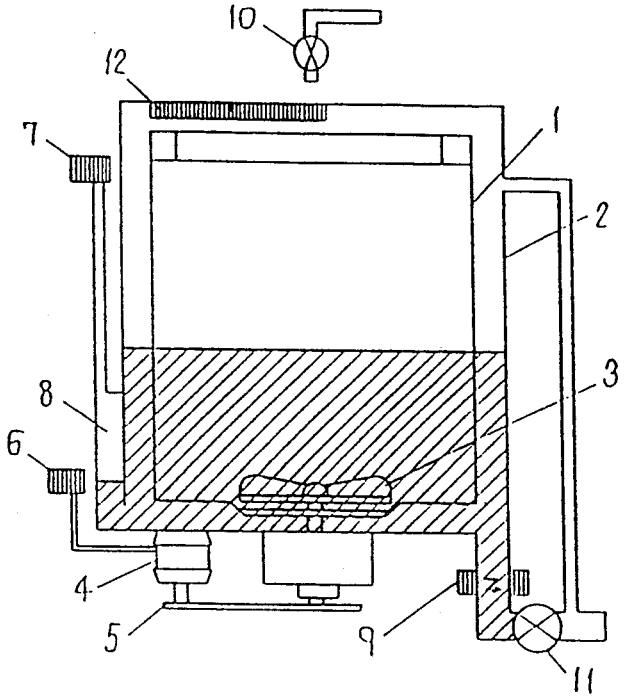
FIG. 1 is a constitutional drawing of a washing machine according to an embodiment of the present invention.

FIG. 1 is a constitutional drawing of a washing machine according to an embodiment of the present invention. In this figure, numeral 1 is a washing tub into which the laundry and washing water are put, numeral 2 is an outer tub in which washing water is reserved. Numeral 3 is a pulsator stirring the laundry and the washing water which is rotated by a motor 4 via a belt 5. Numeral 6 is a cloth amount sensor detecting the load loading on the pulsator 3 at the time of rotation thereof. Numeral 7 is a water level sensor detecting the water volume in the washing tub 1 by detecting the air pressure in the air trap 8. Numeral 9 is a cleaning sensor detecting the degree of deterioration of the washing water in the washing tub 1 by the light-transmittance in a drain hose. Putting in and taking out water into and from the washing tub 1 are controlled by a water supply valve 10 and the drain valve 11 which are driven by a solenoid valve.

Figure 7:
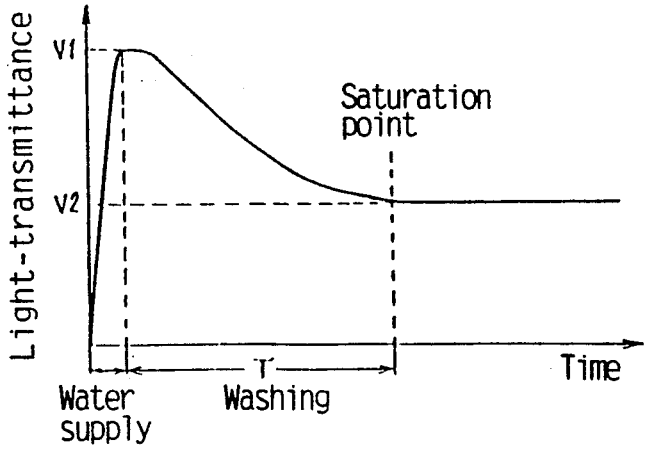
FIG. 7 is a graph showing a function between washing time and light-transmittance.

Next, principle of action of the above-mentioned cleaning sensor 9 is explained. A light-emitting part and a light-receiving are disposed at the drain outlet in a manner that they are facing to each other. Thus the light from the light-emitting part is received by the light-receiving part, thereby the light-transmittance of the washing water can be detected by the amount of the received light. Hereupon the detected value of the cleaning sensor corresponds to the light-transmittance in the present embodiment. This light-transmittance varies depending on the turbidity of the washing water. That is the, degree of removal of soiling of laundry can be detected by the cleaning sensor 9. The variation of the light-transmittance starts, as shown in FIG. 7, from a light-transmittance of V1 at the beginning of the washing. The light-transmittance decreases because of the turbidity increases due to the proceeding of the washing, and reaches a steady state at a light-transmittance V2 after a time length T (hereinafter called as saturation time). That is, the turbidity of the washing water reaches a saturated state. At this time, V2 represents the extent of soiling and T represents the degree of difficulty of removal of soiling of the laundry (hereinafter called as type of soiling).

Hereupon, considering an efficient cleaning of soiling of the laundry, in case of keeping the washing water flow constant, the washing effectiveness is determined by the washing time. Then the consideration is given on how to determine the washing time from the above-mentioned light-transmittance and the saturation time.

Although the light-transmittance and the saturation time represent the extent of soiling and the type of soiling, respectively, determination of the washing time from these variables depends largely on intuition and experience of a user and hence, it is difficult to express it by a mathematical formula. By expressing the user's general know-how by fuzzy rules, an appropriate washing time is determined by fuzzy inference.

Figure 2:
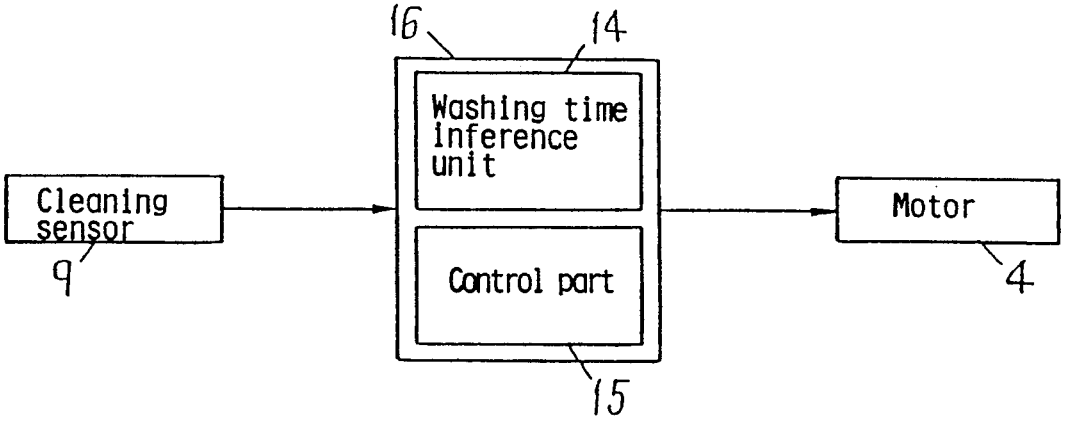
FIG. 2 is a block diagram of a washing machine according to a first embodiment of the present invention.

Next, explanation is given on the control action referring to FIG. 2. In the washing process, the pulsator 3 starts to rotate under the control of the control part 15 controlling the motor 4, thereby a predetermined water flow is produced to start washing. The washing time inference unit 14 determines the washing time by the light-transmittance and the saturation time obtained from the cleaning sensor 9. The control part 15 stops the motor 4 when the above-mentioned washing time passes. The washing process is completed by the action described above. Hereupon, the washing time inference unit 14 and the control part 15 can be realized easily by a micro-computer 16.

Figures 3, 4:
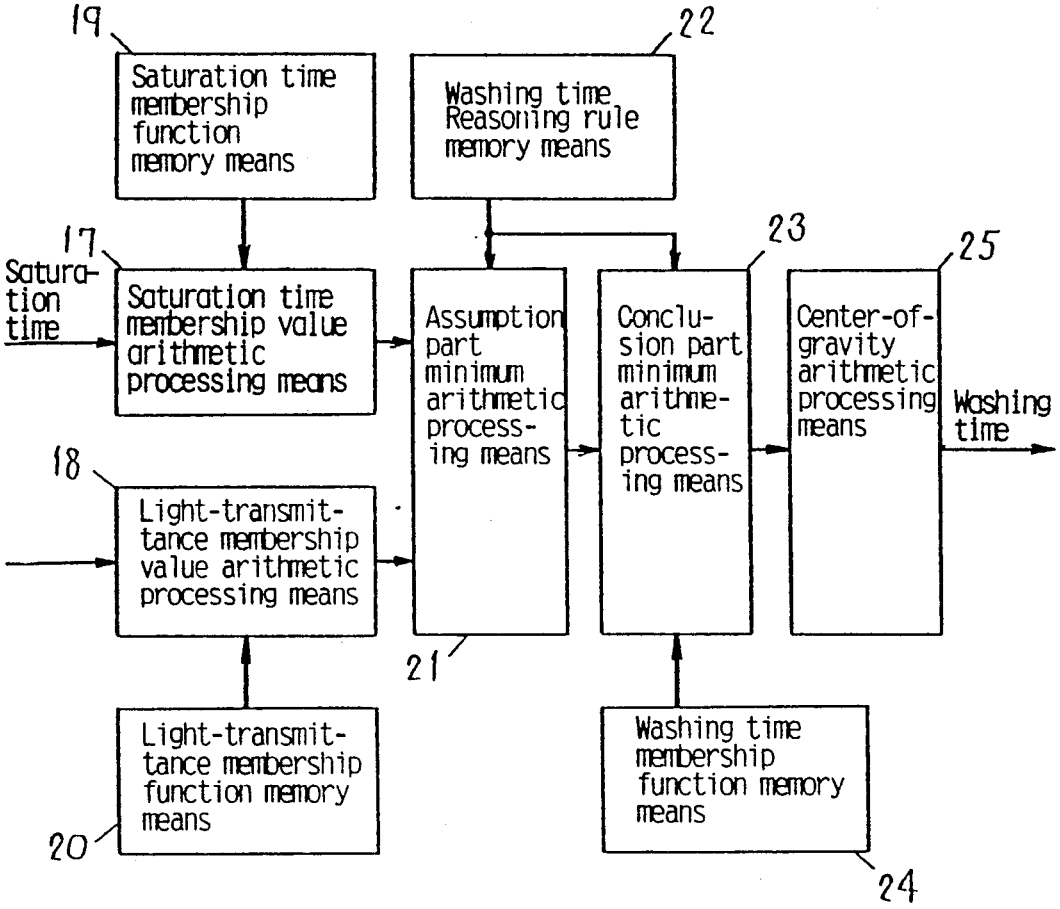
FIG. 3 is a block diagram of a washing time inference unit.
FIG. 4 is a block diagram showing a washing time inference rule of the same.

Next, one embodiment of the washing time determination is explained referring to FIG. 3 to FIG. 6. The washing time is determined by making the fuzzy inference from the information of saturation time and light-transmittance at the time of reaching the saturation obtained by the cleaning sensor 9. The fuzzy inference is made based on six rules such as, as shown in FIG. 4, "when the saturation time is short and the light-transmittance is high, the washing time is made very short". Such the qualitative concept, that the saturation time is "short" or the light-transmittance is "high", or making the washing time "very short", is expressed quantitatively by membership functions shown in FIGS. 5(*a*), 5(*b*), and 5(*c*).

An actual constitution of the washing time inference unit 14 in shown in FIG. 3. In the following, the action of the washing time determination is explained using this figure.

Figure 5A:
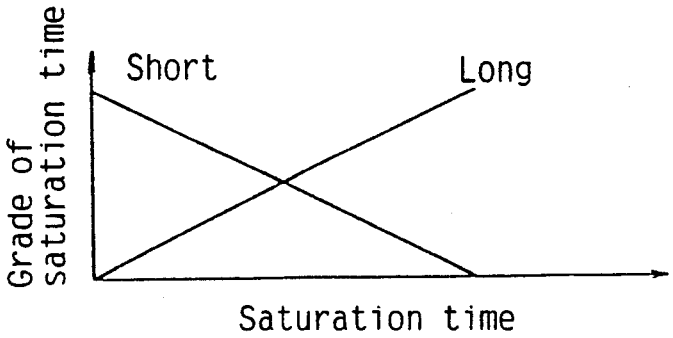
FIGS. 5(*a*), 5(*b*), and 5(*c*) are graphs showing membership functions of saturation time, light-transmittance, and washing time, respectively.
Figure 5B:
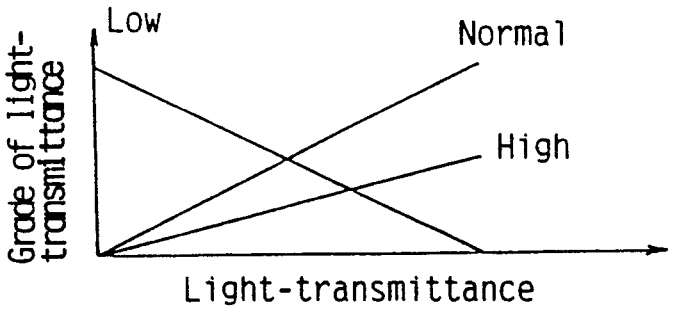
Figure 5C:
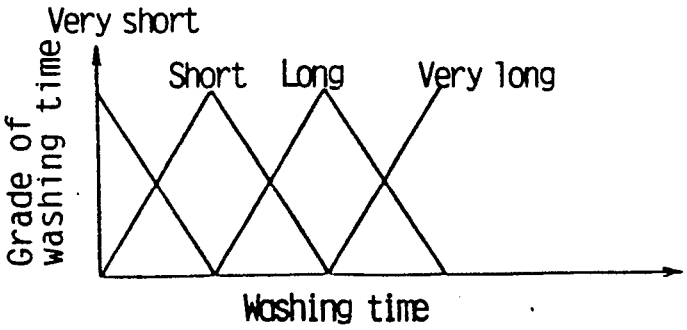
Figure 6:
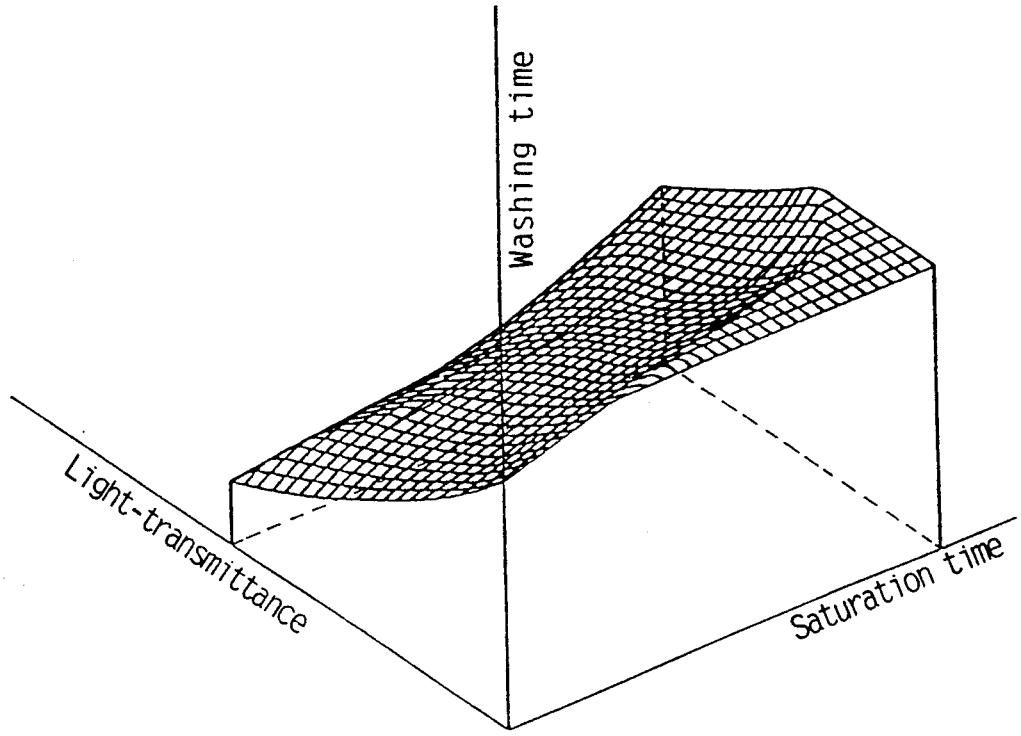
FIG. 6 is a graph showing a result of inference of the washing time inference unit.

First, the saturation time membership value arithmetic processing means 17 receives the time until the light-transmittance reaches saturation after the washing started and calculates the grade (goodness of fit) of the saturation time based on a function stored in a saturation time membership function memory means 19 which memorizes a saturation time membership function shown in FIG. 5(*a*). That is, the above-mentioned saturation time membership value arithmetic processing means 17 issues two different respective classes of grade (goodness of fit) of saturation times of "short" and "long" based on the saturation time membership function. And the light-transmittance membership value arithmetic processing means 18 receives the detecting value (light-transmittance) of the cleaning sensor 9 at the saturation and calculates the grade (goodness of fit) of the light-transmittance based on a function stored in a light-transmittance membership function memory means 20 which memorizes a light-transmittance membership function shown in FIG. 5(*b*). That is, the above-mentioned light-transmittance membership value arithmetic processing means 18 issues three different respective classes of grade (goodness of fit) of light-transmittance of "low", "normal", and "high" based on the light-transmittance membership function. Next, an assumption part minimum arithmetic processing means 21 receives the output of the saturation time membership value arithmetic processing means 17 as well as the output of the light-transmittance arithmetic processing means 18 and at the same time accepts data of a washing time inference rule memory means 22 which memorizes a washing time inference rule. The above-mentioned assumption part minimum arithmetic processing means 21, based on the washing time inference rule memory means 22, compares the membership value of "high" of the light-transmittance membership value arithmetic processing means 18 with the membership value of "short" of the saturation time membership value arithmetic processing means 17, and takes the smaller one (MIN) out of these two membership values as the assumption part membership value in the case of "high" light-transmittance, "short" saturation time, and "very short" washing time. Similarly, an assumption part membership value in case of "normal" light-transmittance, transmittance, "short" saturation time, and "short" washing time is obtained by comparing the membership value of "normal" from the light-transmittance membership value arithmetic processing means 18 and with the membership value of "short" from the saturation time membership value arithmetic processing means 18 (sic), and taking MIN of them. Furthermore, an assumption part membership value corresponding to those six cases shown in FIG. 4 such as "low" light-transmittance, "short" saturation time, and "long" washing time is sought and the result is issued.

Next, a conclusion part minimum arithmetic processing means 23 receives the output of the above-mentioned six assumption part membership value of the assumption part minimum arithmetic processing means 21 as well as reads data of the washing time inference rule memory means 22, and at the same time, reads functions of a washing time membership function memory means 24 which memorizes membership functions shown in FIG. 5(*c*). The conclusion part minimum arithmetic processing means 23 calculates four different MIN's between six different assumption part membership values calculated according to the washing mode inference rule and four different grades of "very short", "short", "long", and "very long" in the membership functions. That is, the membership function of "very short" washing time is cut at its top part with the assumption part membership value (grade) in the case of "high" light-transmittance, "short" saturation time, and "very short" washing time. Similarly, the membership function of "short" washing time is cut at its top part with two different assumption part membership values (grades) in the case of "normal" light-transmittance and "short" saturation time, or in the case of "high" light-transmittance and "long" saturation time, and then the larger one is taken as (MAX) out of these two assumption part matching (grade). Then, also on the membership functions of "long" and "very long" washing time, they are cut by respective assumption part matching (grade) at their top parts, and thereby the washing time membership function of FIG. 5(*c*) is corrected to be a combination of trapezoids.

Finally, a center-of-gravity arithmetic processing means 25 takes the center of gravity of an area surrounded by the membership function obtained by the conclusion part minimum arithmetic processing means 23, and a washing time at this center of gravity is issued as the final washing time.

Hereupon, the light-transmittance membership function is composed of weighted monotonous type membership functions which are shown in FIG. 5(*b*). Its function is explained using FIG. 8 and FIG. 9. As shown in FIG. 8(*a*), taking labels of respective membership functions of a weighted monotonous type membership function are taken to be A, B, and C, rule of the fuzzy inference is taken to be such as shown in FIG. 8(*b*). In this example, the conclusion parts are taken to be real numbers. For the inference processing, an ordinary MIN-MAX method is used. In the fuzzy inference of this constitution, the input-output characteristic when the slope of the membership function C is changed becomes such as shown in FIG. 9. As shown in this figure, it is understood that, by changing the slope of the membership function C, various sorts of second-order curves can be easily expressed.

Using the effect of the weighted monotonous-type membership function as has been described above, in the present embodiment, by adjusting the slope of the membership function expressing that the light-transmittance is high shown in FIG. 5(*b*), a fuzzy inference unit suitable to the object can be easily constituted.

The result of inference obtained by the washing time inference unit 14 explained above expresses suitably a complex and difficult-to express relation of the washing time depending on the saturation time and the light-transmittance obtained from the cleaning sensor 9. That is, the washing time can be determined finely and most suitably responding to the degree of soiling of the laundry. And although it is considered that the degree of soiling and the washing time are in a linear relationship in a point of view of removal of soiling, if we add factors of such as the damage given by the washing on the cloth or economy onto the above view points, the above-mentioned relationship becomes nonlinear. This is easily understood from that fact that a longer washing time can remove soiling well, but gives more damage on the cloth or a longer washing time is uneconomical on the view point of efficiency. Since the washing time determination by the washing time inference unit 14 is done by adding these factors mentioned above, the most suitable washing time is obtainable.

Hereupon, in the present embodiment, although a triangular shape has been used for the washing time membership function, method in which it is realized by a linear formula or real number can also be considered. And the number of rule is not always limited to six. Moreover, it is needless to mention that the determination of the rinse time can be determined by the similar method as in determination of the washing time.

In the present embodiment, although the cleaning sensor is constituted by a light sensor detecting the light-transmittance, such the method using the change of electric conductivity or using the image processing can also be considered.

Explanation is given on a second embodiment of the present invention using FIG. 1, and FIG. 10 to FIG. 20. In FIG. 10, numeral 9 is a cleaning sensor for detecting the turbidity of the water in the washing tub 1 by the light-transmittance in a drain hose. Numerals 26 and 27 are a timer provided inside a micro-computer and a water flow inference unit, respectively.

In the following, the action of the present embodiment is explained mainly on the action of the water flow inference unit 27. Control of the water flow strength is made by receiving, as the input, the detected value of the cleaning sensor 9, the cloth amount sensor 6, the washing time after starting the washing, and the lapse time after starting the rinse by the micro-computer 26. A motor 4 is driven with ON-OFF times determined by the inference done by the water flow inference unit 27; which is realized with a micro-computer. The determination of the ON-OFF time of the motor 4 by the flow inference unit 27 is done based on the general knowledge we usually have on washing from our experience, such that when the amount of cloth is large, the standard water flow must be made strong, or when the lapse time is short and the variation ratio of the light-transmittance is small, the water flow must be made stronger than the standard water flow.

An actual process of determination of the washing water flow by the fuzzy inference is described below.

Figures 11, 12:
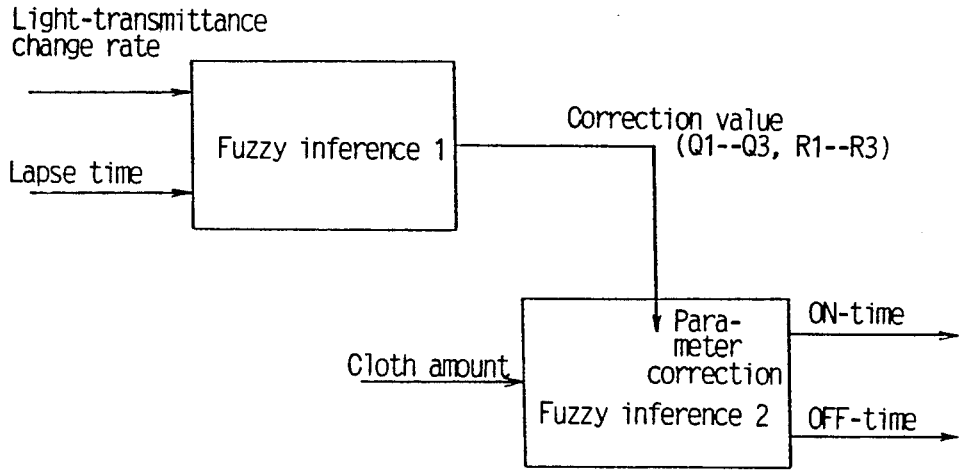
FIG. 11 is an explanatory drawing of inference for water flow of the second embodiment.
FIG. 12 is a drawing showing a inference rule of a inference 1 composing a part of a water flow inference unit of the second embodiment.

The fuzzy inference in the present embodiment comprises a fuzzy inference 1 and a fuzzy inference 2 as shown in FIG. 11. The fuzzy inference 1 (hereinafter called inference 1) determines, by making inference, the amount of correction which expresses magnitude of strengthening or weakening of the water flow from its standard value; wherein the variation ratio of the light-transmission representing the degree of removal of soiling and the lapse time after starting the washing are inputs. The inference rule is such that, for example, "when the variation ratio of the light-transmission is large and the lapse time is short, the water flow is made weaker", and it is composed of four rules shown in FIG. 12.

Figure 13A:
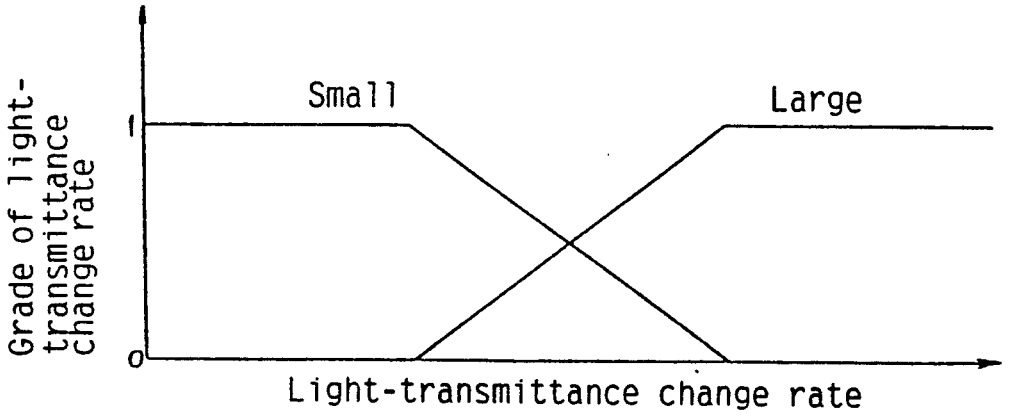
FIGS. 13(*a*) and 13(*b*) are graphs showing membership functions of light-transmittance and lapse time, respectively.
Figure 13B:
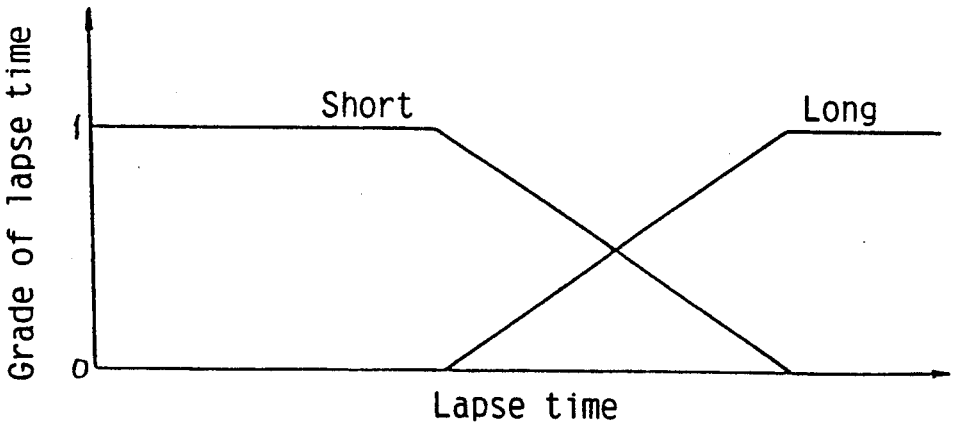
Figure 14:
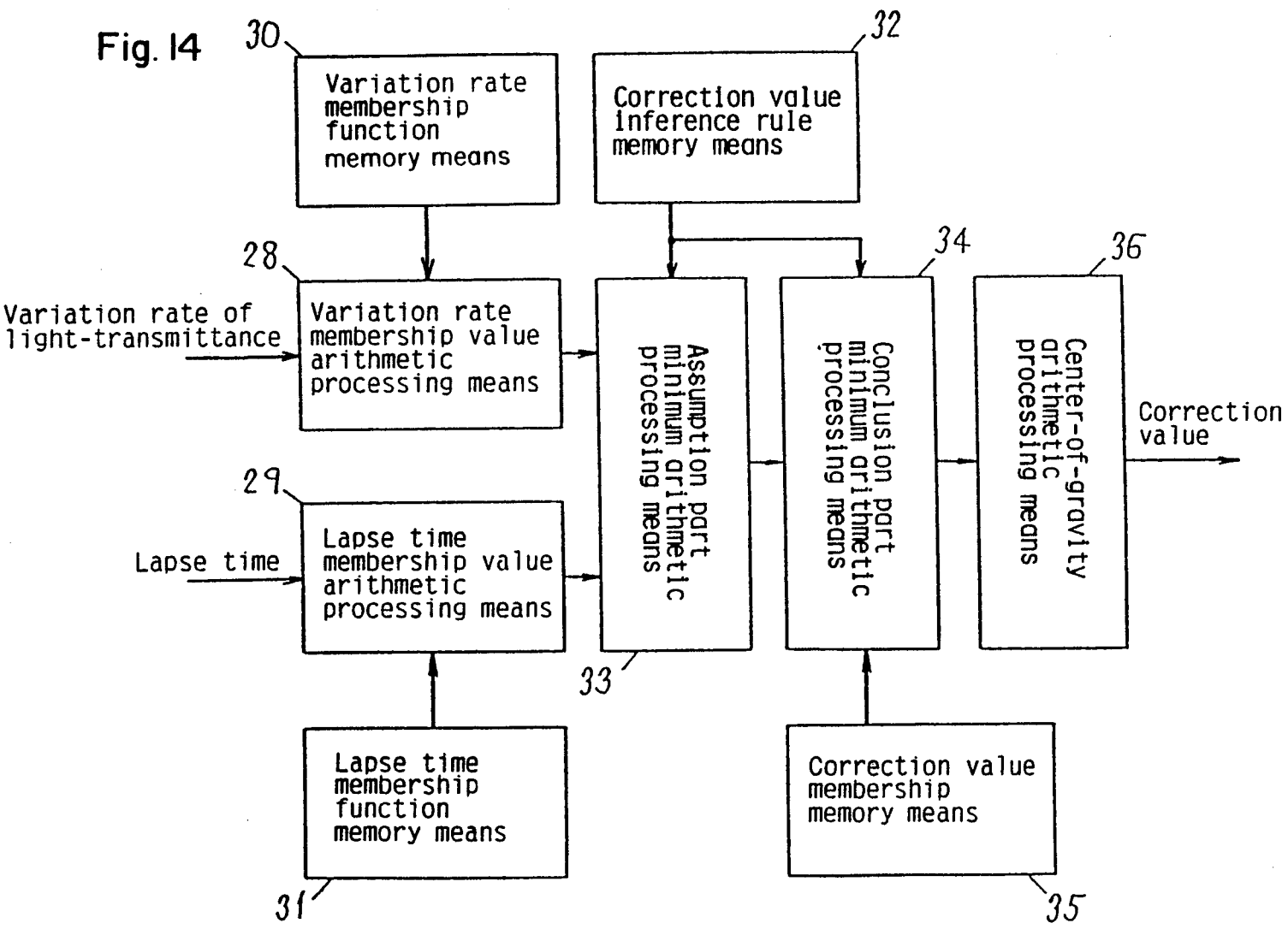
FIG. 14 is a block diagram of the inference 1 of the second embodiment.

Such the qualitative concept that the variation ratio of the light-transmittance is "large" or the lapse time is "long" is expressed quantitatively by membership functions shown in FIGS. 13(*a*) and 13(*b*). The conclusion part of the inference 1 uses values of real numbers represented by Q11 to Q34. and R11 to R34 shown in FIG. 12. Six correction value Q1 to Q3 and R1 to R3 are issued as the inference result. Subsequently, the method of the fuzzy inference is explained. In FIG. 14, a constitution for realizing the inference 1 included in the water flow inference unit 27 is shown. Based on a rule memorized in a correction value inference rule memory means 32, in a variation ratio membership value arithmetic processing means 28, a membership value between the variation ratio of the light-transmittance (i.e., the variation ratio of the output of the cleaning sensor 9) and the membership function memorized in the variation ratio membership function memory means 30 is obtained by taking MAX between them. Similarly, in a lapse time membership value arithmetic processing means 29. a membership value between the lapse time after starting the washing and the membership function memorized in the lapse time membership function memory means 31 is obtained. In the assumption part minimum arithmetic means 33, a MIN between the above-mentioned two membership values is taken to be a membership value of the assumption part. In the conclusion part minimum arithmetic processing unit 34, the MIN between this assumption part membership value and a membership function which is memorized in the conclusion part correction value membership function memory means 35, is taken to be a conclusion for this rule.

Figures 16, 17:
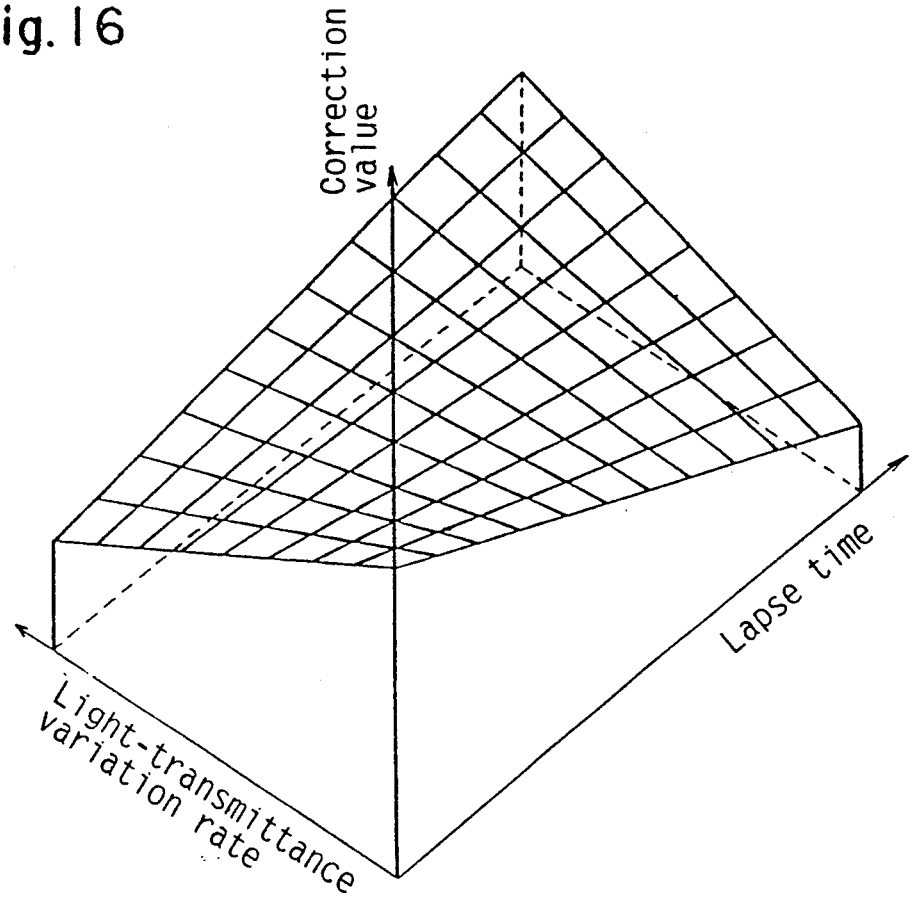
FIG. 16 is a block diagram of an input-output characteristic curve of the inference 1.
FIG. 17 is a graph showing a fuzzy inference rule of the inference 2.

After obtaining respective conclusions on all respective rules memorized in the correction value inference rule memory means 32. a center-of-gravity arithmetic processing means 36, takes the MAX of all conclusions and calculates their center of gravity to obtain the correction value. An example of the input-output characteristic of the inference 1 becomes as shown in FIG. 16.

The fuzzy inference 2 (hereinafter called inference 2) receives the amount of cloth as its input and determines the ON-OFF time of the motor 4 by making inference thereon. The inference rule is such that, for example, "when the amount of cloth is much, the ON time is made longer and OFF time shorter", and it is composed of four rules shown in FIG. 17.

Figure 18:
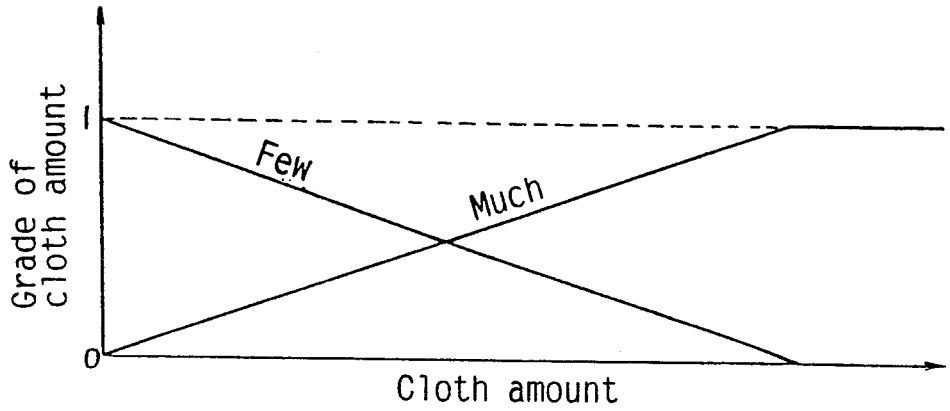
FIG. 18 is a graph showing a membership function of the cloth amount.

The qualitative concept that the amount of cloth is "much" is expressed quantitatively by membership functions shown in FIG. 18. The conclusion part is expressed by f1(x) to f4(x) shown in FIG. 17, which are respectively linear functions such as;

$$f1(x)=a1*x+b1$$

$$f2(x)=a2*x+b2$$

$$f3(x)=a3*x+b3$$

$$f4(x)=a4*x+b4$$

Figure 15:
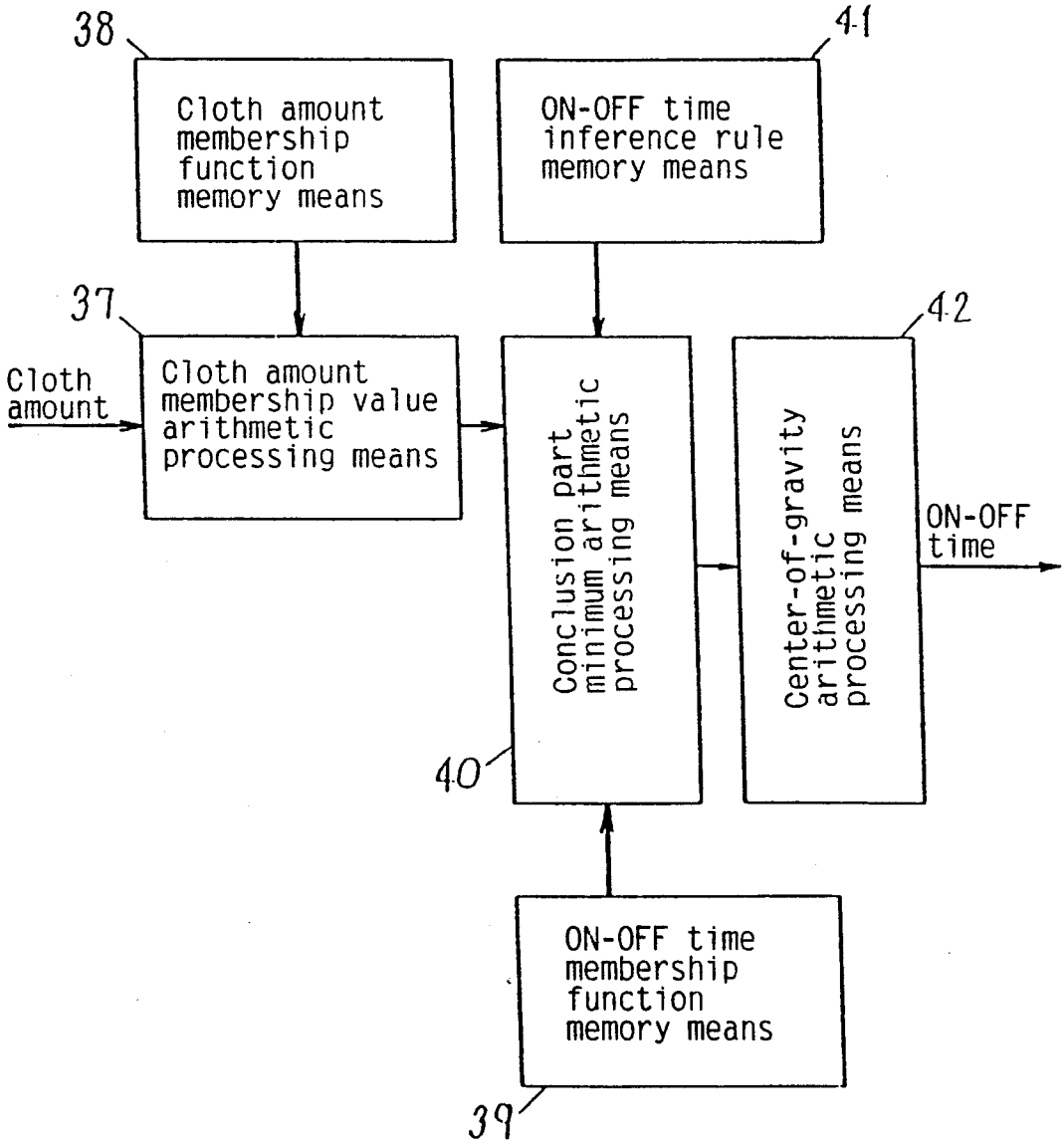
FIG. 15 is a block diagram of a inference 2 composing a part of the water flow inference unit of the second embodiment.
Figure 19:
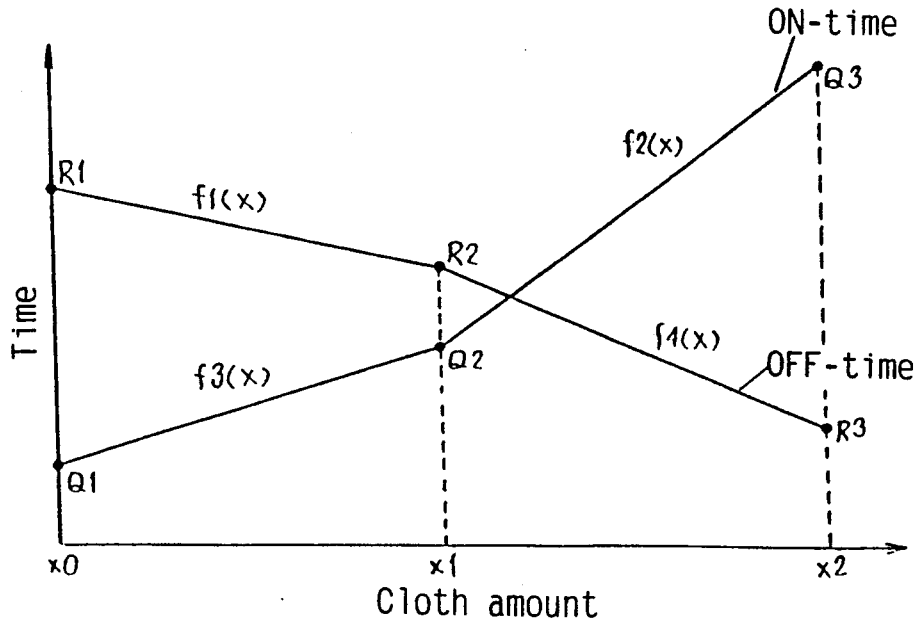
FIG. 19 is a graph showing functions f1(x) to f4(x) of a conclusion part of the inference 2.
Figure 20:
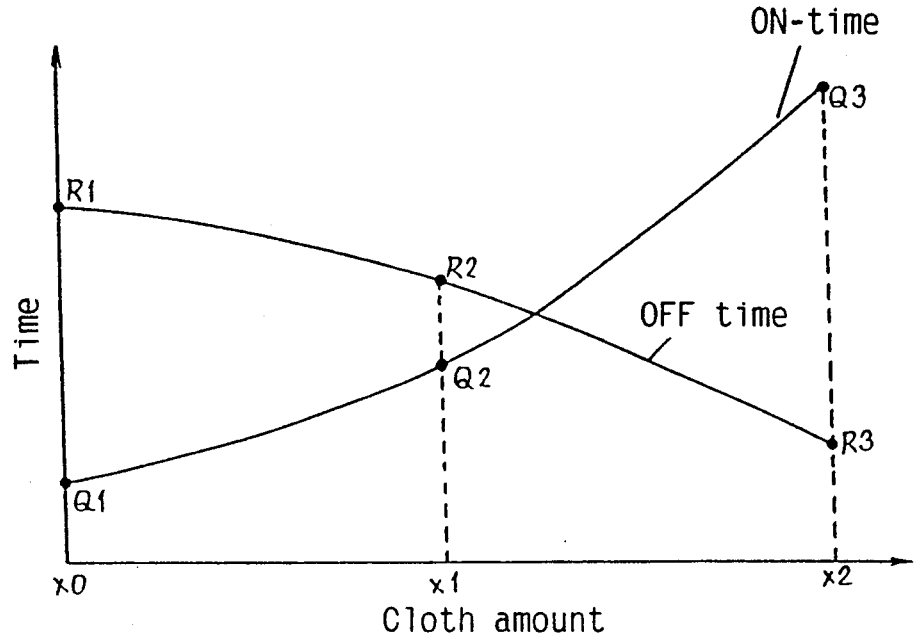
FIG. 20 is an input-output characteristic curve of the inference 2.

Graphic representations of f1(x) to f4(x) are shown in FIG. 19. Wherein, f1(x0), f3(x0), f1(x1) (f2(x1)), f3(x1) (f4(x1)), f2(x2), f4(x2), which characterize respective functions, are equal to Q1 to Q3 and R1 to R3 which are the conclusions of the inference 1. That is, parameters a1 to a4 and b1 to b4 of the conclusion part functions f1(x) to f4(x) are determined by the result of the inference 1. Actual method of the inference 2 is described below. In FIG. 15, a constitution for realizing the inference 2 included in the water flow inference unit 27 is shown. Based on a rule memorized in an ON-OFF time inference rule memory means 41, a cloth amount membership value arithmetic processing means 37 obtains a membership value of the assumption part by taking the MAX of the membership function memorized in the input cloth amount membership function memory means 38. Subsequently, in a conclusion part minimum arithmetic processing means 40, the MIN is taken this assumption part membership value and a membership function memorized in the ON-OFF time membership function in the conclusion part which is memorized in the memory means 39 to obtain the conclusion for this rule. After obtaining respective conclusions on all respective rules memorized in the ON-OFF time inference rule memory means 41, a center-of-gravity arithmetic processing means 42 takes the MAX of all conclusions and calculates their center of gravity to obtain the ON-OFF time. An example of the input-output characteristic of the inference 2 becomes as shown in FIG. 20. As is understood from FIG. 20, the input-output characteristic is such that when the amount of cloth is much (i.e., large), the ON time is made longer and the OFF time is made shorter, that is, the water flow is made stronger. This is because a pulsator 3 is disposed on the bottom of the washing tub 1 as is seen in FIG. 1, then as the amount of cloth increases, propagation of the water flow up to the upper layer becomes harder and hence the water flow strength must be made stronger.

The reason for the determination of parameters of the inference 2 by six outputs of the inference 1 is because, when the water flow is made stronger, the degree of strengthening is different depending on the amount of cloth.

By setting those parameters constituting the inference 1 and the inference 2 based on the knowledge we usually have from our experience, the ON-OFF control (water flow control) of the motor 4 by the water flow inference unit 27 becomes most suitable when the amount of cloth, the degree of soiling, the washing time is taken into account.

The water flow control action by the water flow inference unit 27 becomes such as described below. That is, the washing is done with an adequate strength responding to the amount of cloth at the starting time of washing, and when the soiling seems difficult to be removed, the water flow is made stronger. Then when the soiling starts being removed, the water flow is weakened so as to avoid damages to be given on the cloth. Also in case that the soiling is not removed for a long time, the water flow is weakened for the same purpose. And, in spite of lasting the washing for a considerably longer time, the soiling is removed sufficiently (sic), the water flow is made stronger so as not to lengthen the washing time by removing the soiling quicker.

Since the water flow control in accordance with the water flow inference unit 27, as described above, makes the action which is similar that we make from our experience, an adequate washing taking the amount of cloth and the damage given on the cloth into account. Further, the washing is responsive to the soiling of the cloth.

Hereupon, in the present embodiment, although the description has been done on the washing water flow control by the water flow inference unit 27, it is needless to mention that the same can be applied also on the rinse water flow control. And although it has been described that "in spite of lasting the washing for a considerably longer time, the soiling is removed sufficiently (sic), the water flow is made stronger so as not to lengthen the washing time by removing the soiling quicker", in this case, another method wherein the removal of the soiling is made easier by supplying the water through a water supply valve 10 can also be considered. And also still another method in which the removal of the soiling is made easier by a control of the washing water temperature can be considered.

In the agitation type washing machine and the drum type washing machine, the output of the fuzzy inference is taken to be respectively the driving speed of an agitator and the revolving speed of a drum.

At this time, sensing of the amount of cloth can be detected with the load current of the agitator or the drum, and the degree of the soiling can be detected in the similar manner as in the present embodiment.

Figure 21:
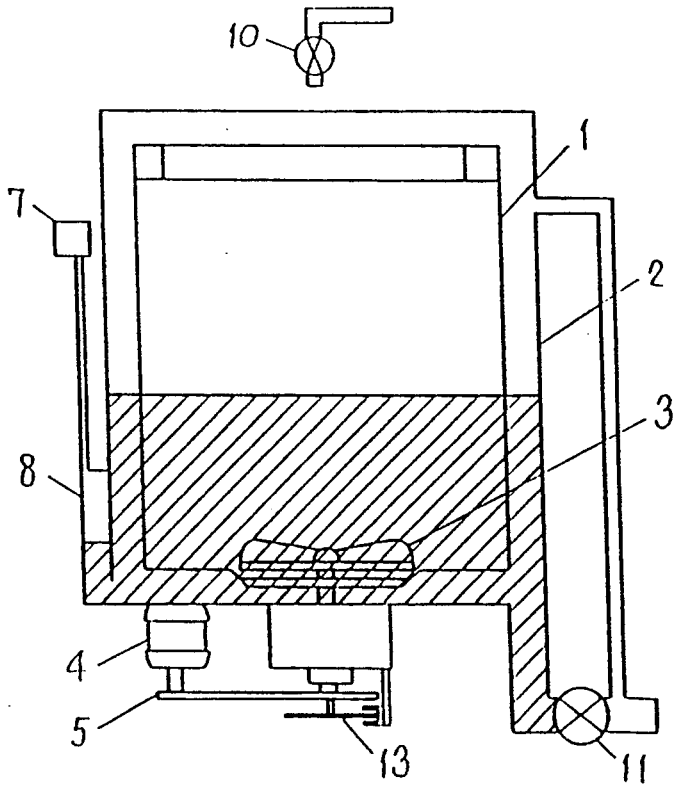
FIG. 21 is a constitutional drawing of a washing machine according to a third embodiment of the present invention.

Next, explanation is given on a third embodiment of the present invention using FIG. 21 to FIG. 28. In FIG. 21, in the water-extraction process, the washing tub 1 is driven by the motor 4, and numeral 13 is a second cloth amount sensor detecting the revolving speed of the washing tub 1 during the revolution thereof by an encoder. Hereupon this second cloth amount sensor 13 is for detecting the weight of cloth. The reason for this is that the revolving speed of the washing tub 1 is determined by the weight of the cloth without depending on such as the volume of the cloth.

Figures 22, 23:
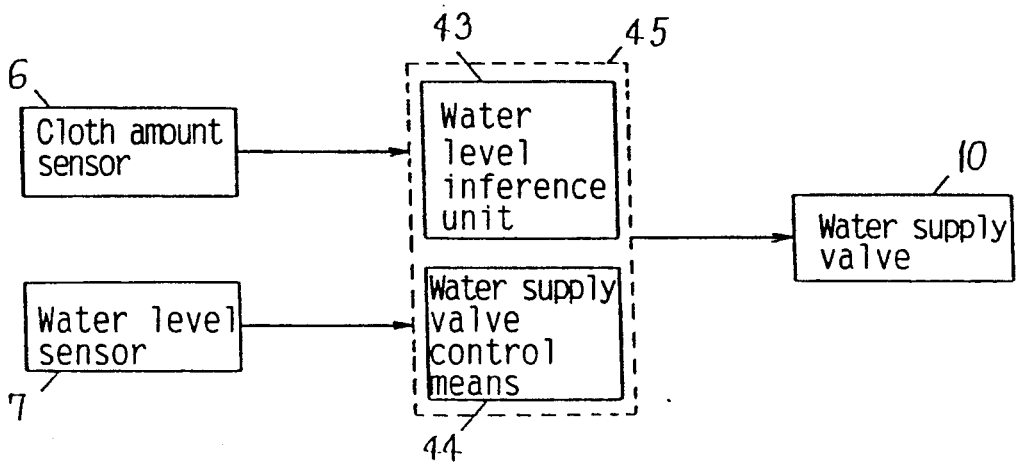
FIG. 22 is a block diagram of the washing machine of the third embodiment.
FIG. 23 is a inference rule of a water level inference unit third embodiment.
Figure 24:
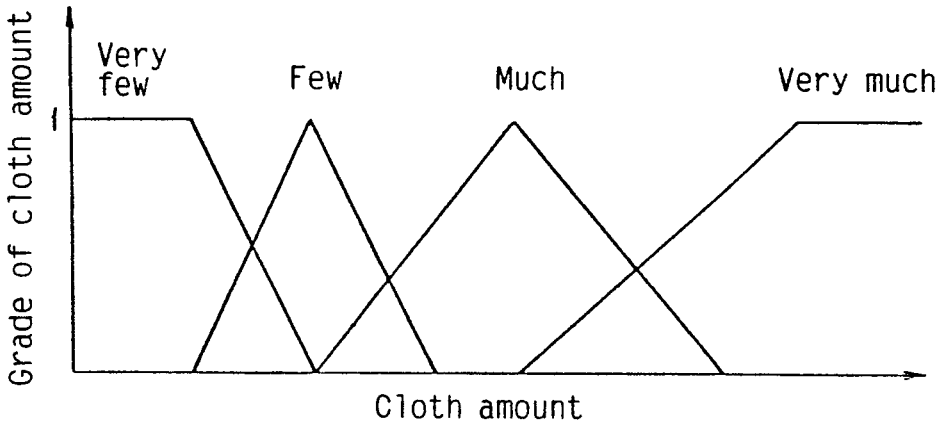
FIG. 24 is a graph showing membership function of the laundry volume.
Figure 25:
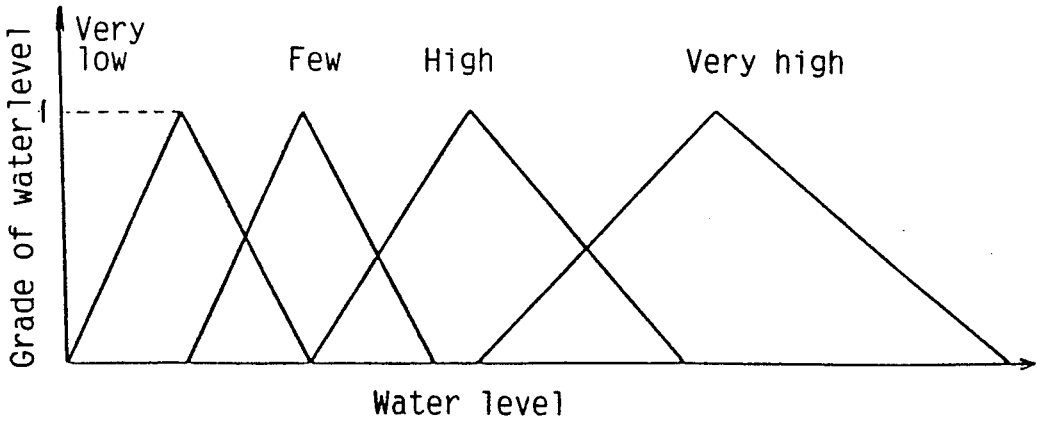
FIG. 25 is a graph showing membership function of water level.

Next, explanation is given on the determination of the washing water level at the time of washing referring to FIG. 22. The determination of the washing water level comprises two stages of a determination, first, the water-supply predetermined water level at the starting time; and, second, a judgement of water-supply completion. The first determination of the water-supply predetermined water level is done by a water level inference unit 43 which is realized by a microcomputer 45. An inference at this time is done based on the judgement that a user of the washing machine usually does such that "when the amount of cloth is much, the water level must be high", or "when the amount of cloth is few, the water level must be low". Rule of the inference is composed of four rules shown in FIG. 23. The qualitative concept that the amount of cloth is "much" or "few" is expressed quantitatively by membership functions such as shown in FIG. 24. The qualitative concept that making the water level "high" or "low" is expressed quantitatively by membership functions such as shown in FIG. 25.

Figure 26:
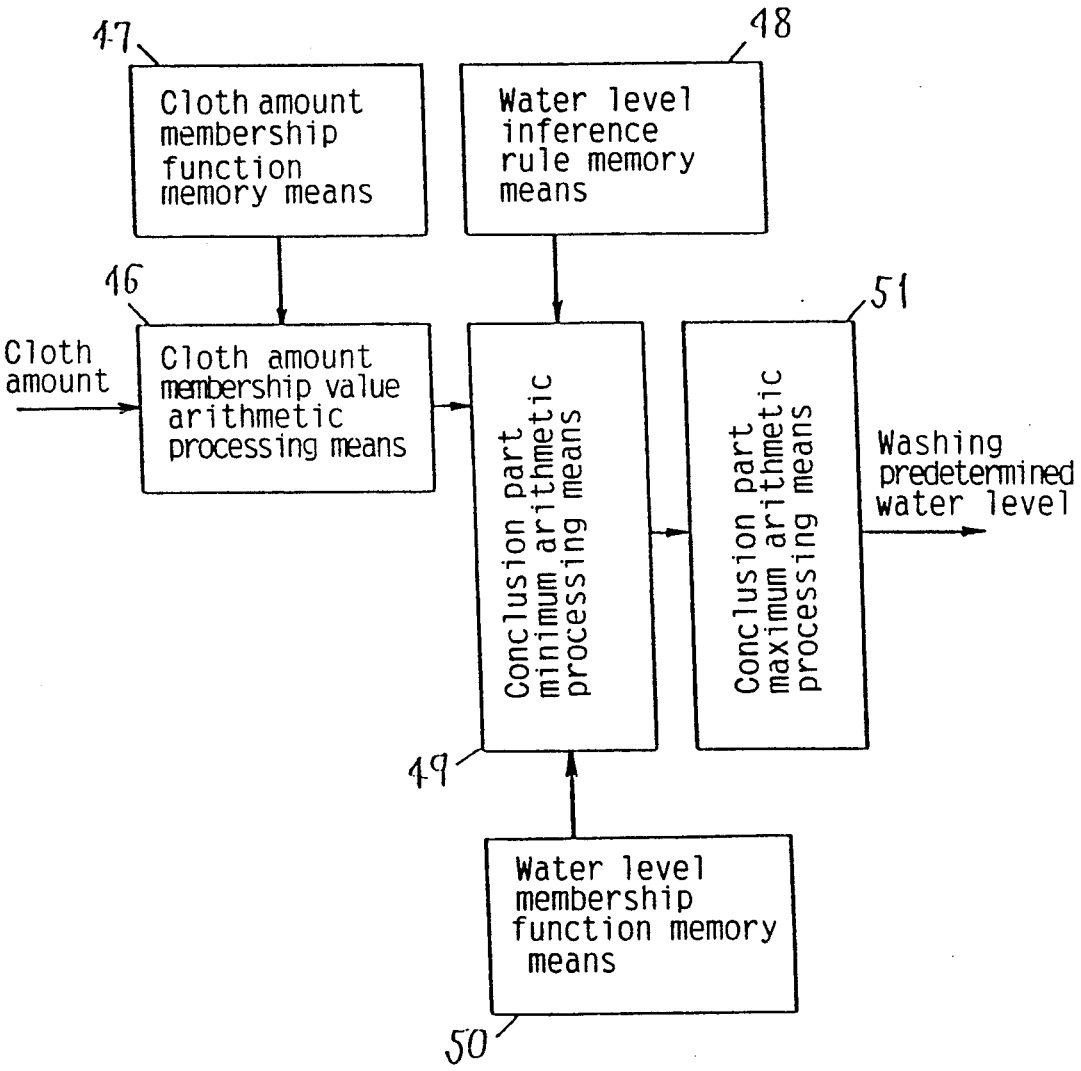
FIG. 26 is a block diagram of a water level inference unit.
Figure 27A:
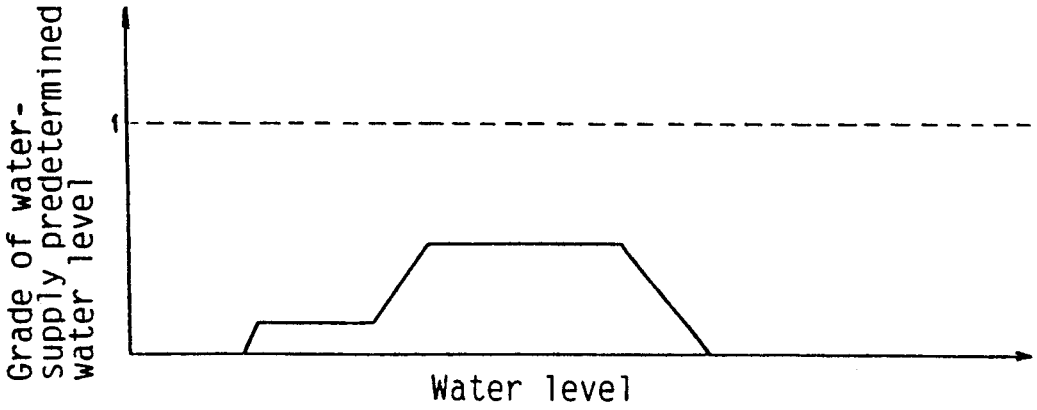
FIGS. 27(*a*), 27(*b*), and 27(*c*) are graphs showing membership functions of water supply predetermined water level, integrated water supply predetermined water level, and judgement for completion of water supply, respectively.
Figure 27B:
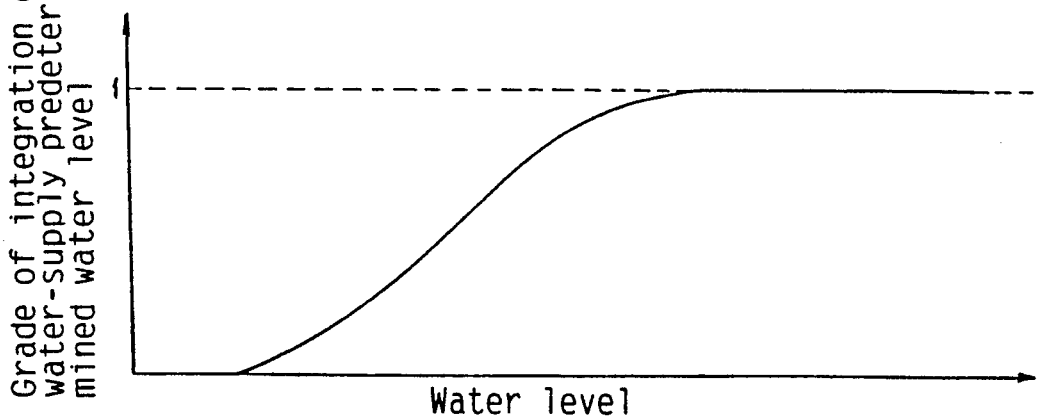
Figure 27C:
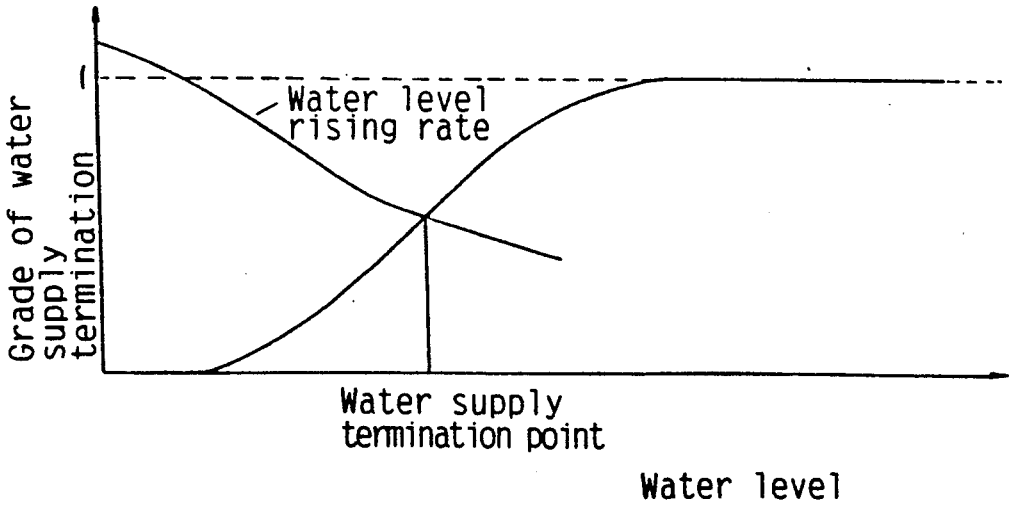
Figure 28:
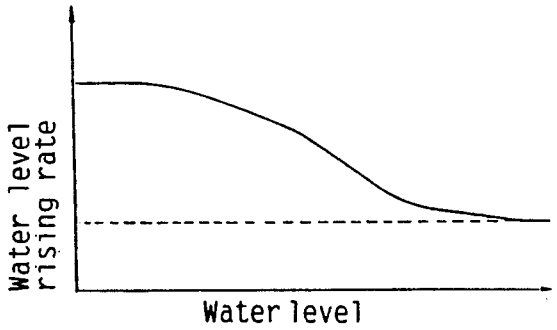
FIG. 28 is a graph showing a relation between water level and water level rising rate.

Next, an arithmetic procedure of the inference process is described based on FIG. 26. First, in a cloth amount membership value arithmetic processing means 46, a membership value of the assumption part of the input, that is, for the detected value of the second cloth amount detector 13 is obtained by taking MAX between the input and membership functions memorized in a cloth amount membership function memory means 47. Then, in a conclusion part minimum arithmetic processing means 49, based on a rule memorized in a water level inference rule memory means 48, the MIN between membership functions memorized in the water level membership function memory means 50 and the assumption part membership value is taken to be a conclusion for this rule. After getting the respective conclusions for the rules, by taking MAX out of all these conclusions by a conclusion part maximum arithmetic processing means 51, a predetermined washing water level 51 is obtained as the final conclusion. This predetermined washing water level is expressed in a shape of a membership function as shown in FIG. 27(*a*), which shows respective possibilities of determination of water level at respective water levels. Next, explanation is given on a judgement of the water supply completion during the second water supply referring to FIGS. 27(*a*)–27(*c*). First, the integration of the membership function of the water supply predetermined water level shown in FIG. 27(*a*) obtained from the first stage is normalized so that maximum value of the grade becomes 1. This takes a shape as shown by FIG. 27(*b*), which shows respective possibilities of completion of water supply depending upon the water levels. The water level rising rate obtained from the detected value of the water level sensor during the water supply becomes small as the water level rises and finally converges to a predetermined value as shown in FIG. 28. This decrease of the water level rising rate accompanied by the water level rising is due to a cloth density distribution caused by a stacking of the laundry inside the washing tub 1. Namely, the cloth density is highest at the bottom of the washing tub 1 and it decreases as the height from the bottom of the washing tub increases. The final convergence of the water level rising rate to a predetermined value is because the water level rising rate is determined by the size of the outer tub 2 after the laundry is submerged completely in water. Judgement of the water supply completion is made by a comparison of this water level rising rate with the above-mentioned water supply predetermined water level. As shown in FIG. 27(*c*), when the water level rising rate becomes lower than the water supply predetermined water level, it is taken as the water supply completion and the water supply valve 10 is closed. These comparison action and the control of the water-supply valve are made by a water-supply valve control means 44 realized by a micro-computer 45. As is easily understood from FIG. 27(*c*), even if the water supply predetermined water level is constant, when the volume of cloth is low, the water level becomes low, while the cloth volume is high, the water level becomes high.

Hereupon, although it is explained that the water-supply predetermined water level is expressed by a fuzzy set, and the final water level is determined by a comparison with the water level rising rate, the water level can also be determined directly by determining the water level with respect to the center of gravity of the membership function of the water-supply predetermined water level which is obtained at the initial stage.

In the above, although the explanation has been given on the determination process of the water level at the time of washing, the water level determination at the time of rinse can also be done by the similar process. By determining the water level by the process as described above, the most suitable water level which takes both the weight and volume of the cloth into account can be obtained. And, as for the second cloth amount sensor, a method in which the amount of cloth is measured directly using a weight sensor can also be considered.

Figure 29:
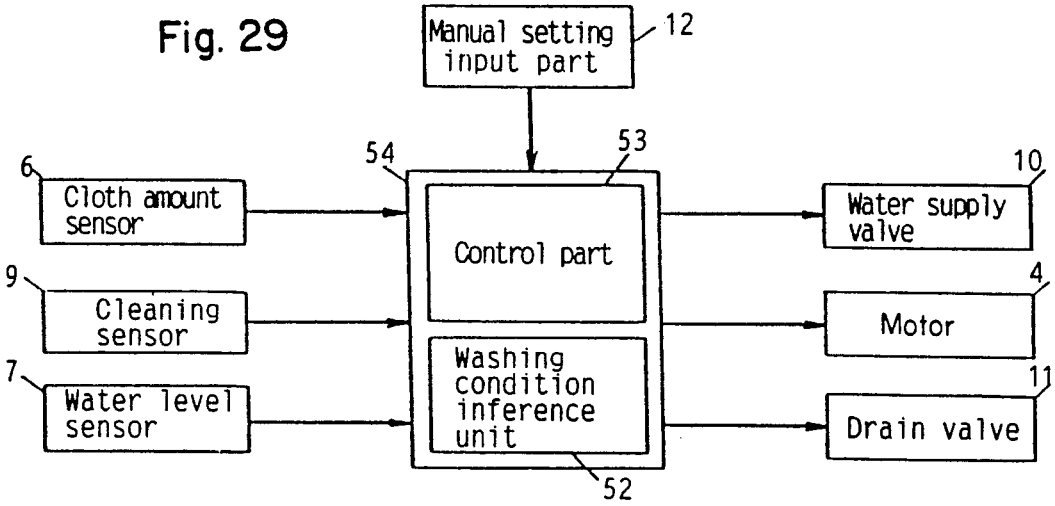
FIG. 29 is a block diagram of a washing machine a fourth embodiment of the present invention.
Figure 30:
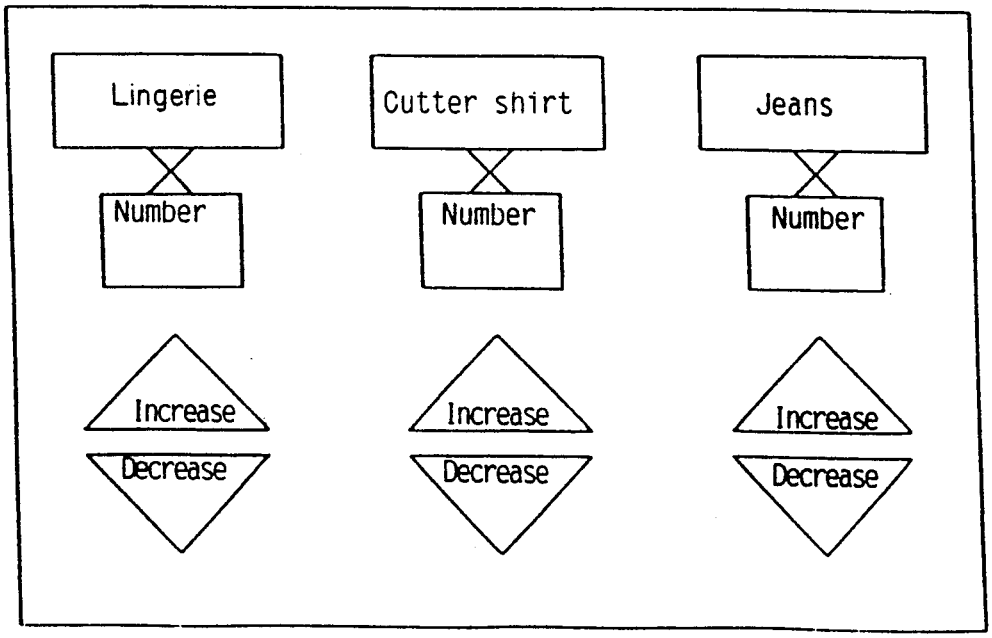
FIG. 30 is a drawing showing a manual-setting input part.

Explanation is given on a fourth embodiment of the present invention using FIG. 1 and FIG. 29 to FIG. 33. In FIG. 1, numeral 12 is a manual-setting input part accepting manual inputs by an operator and it has a panel configuration as shown in FIG. 30 which accepts the sort and number of the laundry.

Next, explanation is given on the control action referring to FIG. 29. Respective basic processes are performed by means that a control part 53 controls a motor 4, a water supply valve 10, and a drain valve 11 based on various washing conditions. Various washing conditions are determined by means that the washing condition inference unit 52 makes the fuzzy inference with having detected values of the cloth amount sensor 6 and of the cleaning sensor 9 and information from the manual-setting input part 12 as the input thereof. Hereupon, the above-mentioned washing condition inference unit 52 and the control part 53 can be easily realized by a micro-computer 54.

Next, explanation is given on one embodiment of the washing water volume determination. The water volume at the initial stage of the washing is determined by the information of the manual-setting input part 12 on which the user operated and the water level information detected by the water level sensor 7. Thereafter, the determination of the washing water volume is done by making fuzzy inference from the detected value of the cloth amount sensor 6 and the information from the manual-setting input part. The control part 53 controls the water supply valve 10 based on the determined water volume. The fuzzy inference is made by a rule based on a know-how that the user generally knows such that "when the laundry is a sort of lingerie and the cloth amount is fairly much, the water volume is made fairly very much", and it comprises nine rules shown in FIG. 31. The qualitative concept that the amount of cloth is "fairly much" or the water volume is "fairly very much" is expressed quantitatively by membership functions such as shown in FIGS. 32(*a*) and 32(*b*). The membership value of the assumption part on the sort of the laundry, in case of the lingerie for example, is determined by the ratio of the amount of lingerie occupying in the total amount of the laundry.

Figure 33:
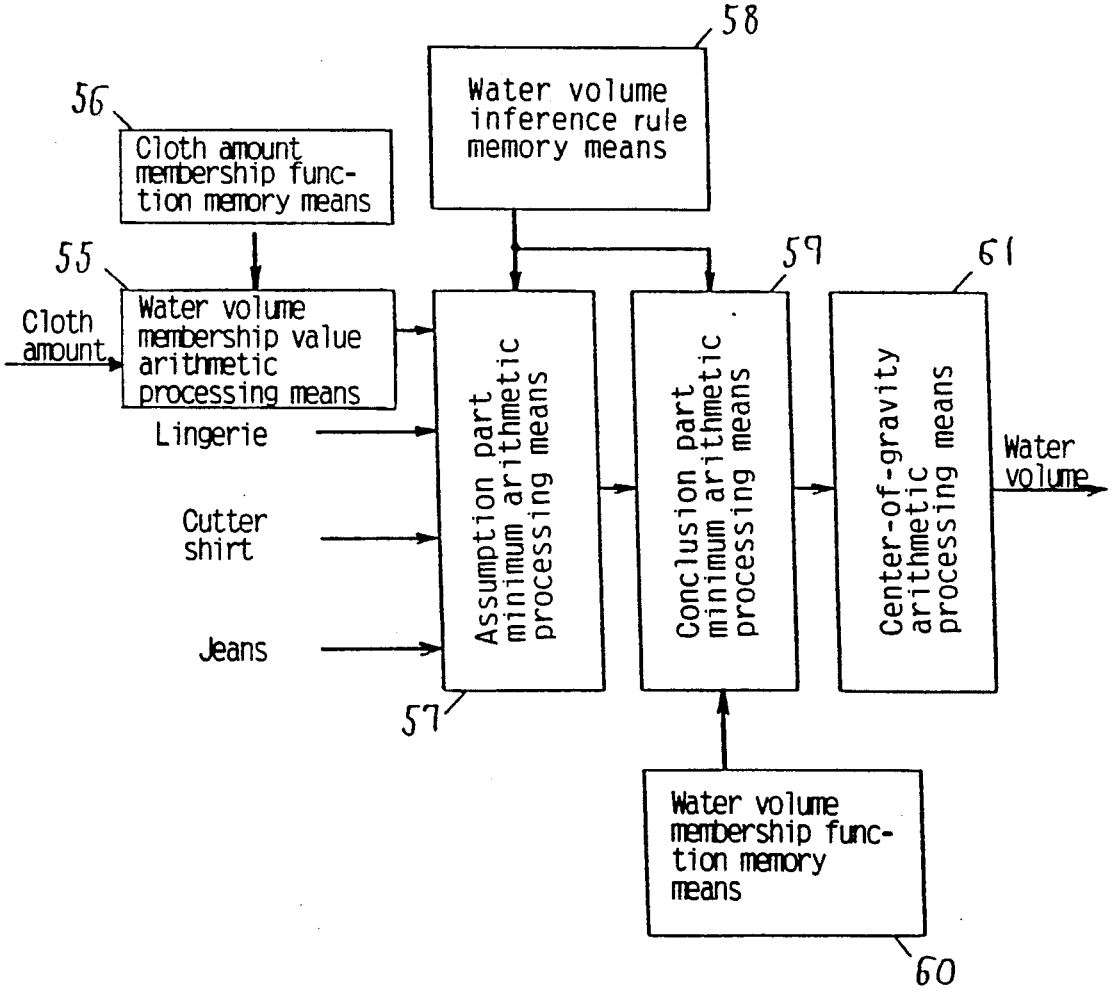
FIG. 33 is a block diagram of a washing condition inference unit.

Next, a method of arithmetic procedure of the inference process is described. In FIG. 33 an actual constitution of a washing condition inference unit 52 is shown. In the following explanation is given using this figure. First, in accordance with a rule memorized in a water volume inference rule memory means 58, a cloth amount membership value arithmetic processing means 55 inputs the detected value of the cloth amount censor 6 and takes the max of the membership functions memorized in a cloth amount membership function memory means 56. Then, in an assumption part minimum arithmetic processing means 57, the membership value of the assumption part is determined by taking the MIN of the MAX value and a ratio (grade) of the amount of input cloth sort occupying in the total amount of the laundry. Next, in the conclusion part minimum arithmetic processing means 59, by taking MIN between membership functions memorized in the water volume membership function memory means 60 and the assumption part membership value, the conclusion for this rule is taken. Moreover, after getting respective conclusions for all rules memorized in the water volume inference rule memory means 58, the center of gravity is determined by taking the MAX of all the conclusions in a center-of-gravity arithmetic processing means 61. Thus, the washing water volume is obtained as a final conclusion.

In the water volume determination by the fuzzy inference explained above, careful washing taking the sort of the laundry into account in a manner that, for susceptible laundry such as lingerie, the water volume is increased to avoid damage of cloth. Whereas, for tough washes such as jeans, the water volume is decreased to wash out soiling positively.

Hereupon, in the present embodiment, although the sorts of the laundry to be specified by the manual-setting input has been limited to be three, this limit is not necessary. It is needless to mention that the greater the number of the sorts to be specified, the more carefully the washing can be done. In the present embodiment, description has been made on the determination of the water level for the washing water, but the same can be applied also on the determination of the water level for the rinse. Moreover, by the same procedure as the determination of the washing water level, it is also possible to perform control of the washing water flow and rinse water flow, control of washing time, rinse time, water-extraction time, water-extraction revolution control, and temperature control of washing water. At this time, by applying the detected value of the cleaning sensor 9 to the input of a washing condition inference unit 52, it also becomes possible to obtain the most suitable water flow control as well as time control responding more finely to the state of soiling of the laundry. Although the conclusion part variable of the fuzzy conditioning has been taken to be a triangular shape, such a method that the realization thereof using values or a function of real numbers can also be considered.

Explanation of a fifth embodiment of the present invention is given using FIG. 1 and FIG. 34 to FIG. 51.

In FIG. 1, numeral 12 is a manual-setting input part accepting manual inputs by an operator and it is comprised of a slide resistor and has a constitution through which such quantities as the amount of the water volume, degree of the extent of soiling, and degree of the strength of the washing can be input as analogue values.

Figures 34, 35A, 35B:
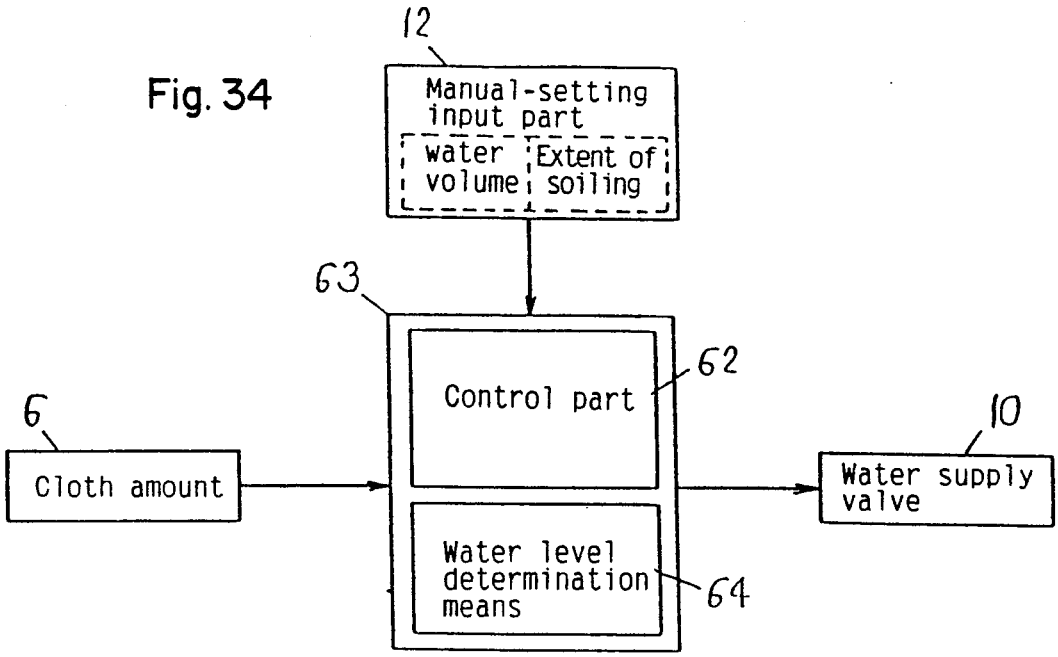
FIG. 34 is a block diagram of in a first means in a washing machine of a fifth embodiment of the present invention.
Figure 36A:
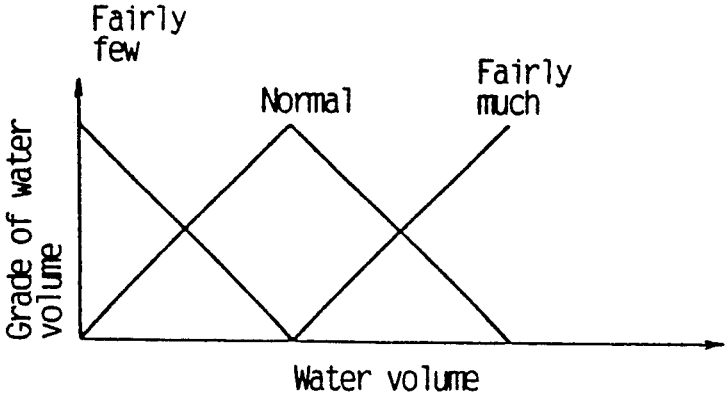
FIGS. 36(*a*), 36(*b*), and 36(*c*) are respectively, graphs showing membership functions of water volume, extent of soiling, and amount of correction.
Figure 36B:
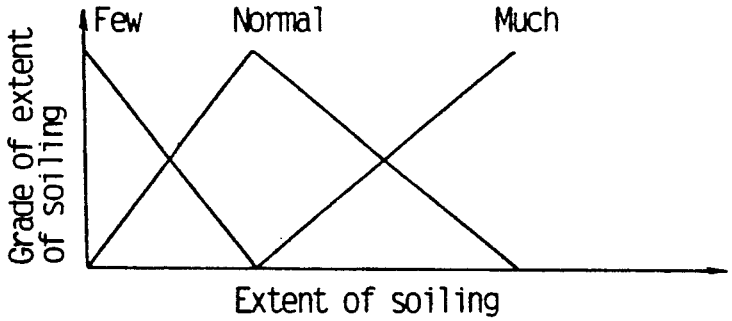
Figure 36C:
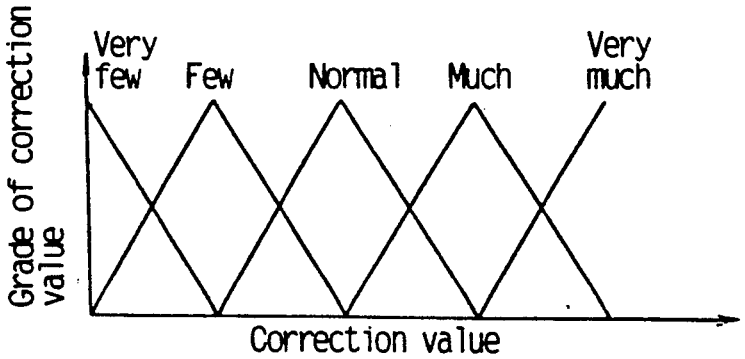
Figure 37:
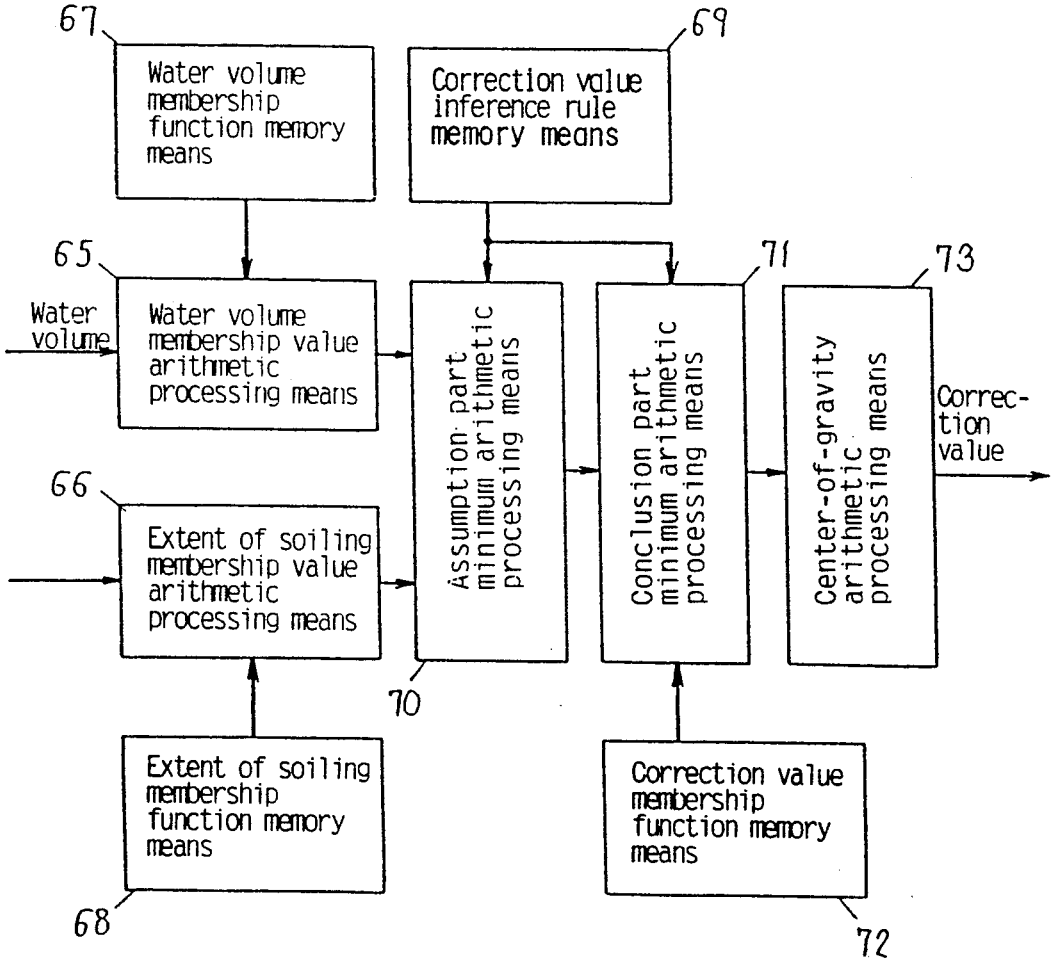
FIG. 37 is a block diagram of a fuzzy inference unit for determining the amount of correction.

Next, explanation is given on the determination of the water level of the washing water by a first means. FIG. 34 is one embodiment of the first means, the determination of the water level of the washing water comprises two steps, that is a determination of correction value of the water level according to the input information such as the amount of the water volume, degree of the amount of soiling either from the manual-setting input part 12 and a determination of a suitable water level by the above-mentioned correction value and the detected value from the cloth amount sensor 6. These determinations of the correction value and the suitable water level are both done by the fuzzy inference in the water level determination means 64. A fuzzy inference in the first step is done based on a general judgement such that "when the water volume is fairly much and the soiling is much, the correction value is made very much". Rule of the inference comprises nine individual rules shown in FIG. 35(*a*). Those qualitative concepts such that the water volume is "fairly much", the soiling is "much", or the correction value is "very much" are expressed quantitatively by membership functions as shown in FIGS. 36(*a*), 36(*b*), and 36(*c*). The fuzzy inference has a constitution as shown in FIG. 37, wherein in a water volume membership value arithmetic processing means 65, a membership value is obtained by taking the MAX between the external input water volume and the membership functions stored in water volume membership function memory means 67. In extent of soiling membership value arithmetic processing means 66, a membership value on the amount of the soiling is similarly obtained from an externally input amount of soiling and the membership functions stored in extent of soiling membership function memory means 68. In an assumption part minimum arithmetic processing means 70, the MIN between those above-mentioned two membership values, is taken as a membership value for the assumption part. In a conclusion part minimum arithmetic processing means 71, the MIN between the assumption part membership value and the correction value membership function of the conclusion part, is taken to be a conclusion of this rule.

After obtaining each conclusion on all of the rules, the MAX of all conclusions in a center-of-gravity arithmetic processing means 73, is used to determine the the correction value.

Those membership functions concerning the water volume, amount of soiling, and correction value are obtained by referring respectively to a water volume membership function memory means 67, a extent of soiling membership function memory means 68, and a correction value membership function memory means 70. And the inference rule is obtained by referring to a correction value inference rule memory means 69.

Figure 38:
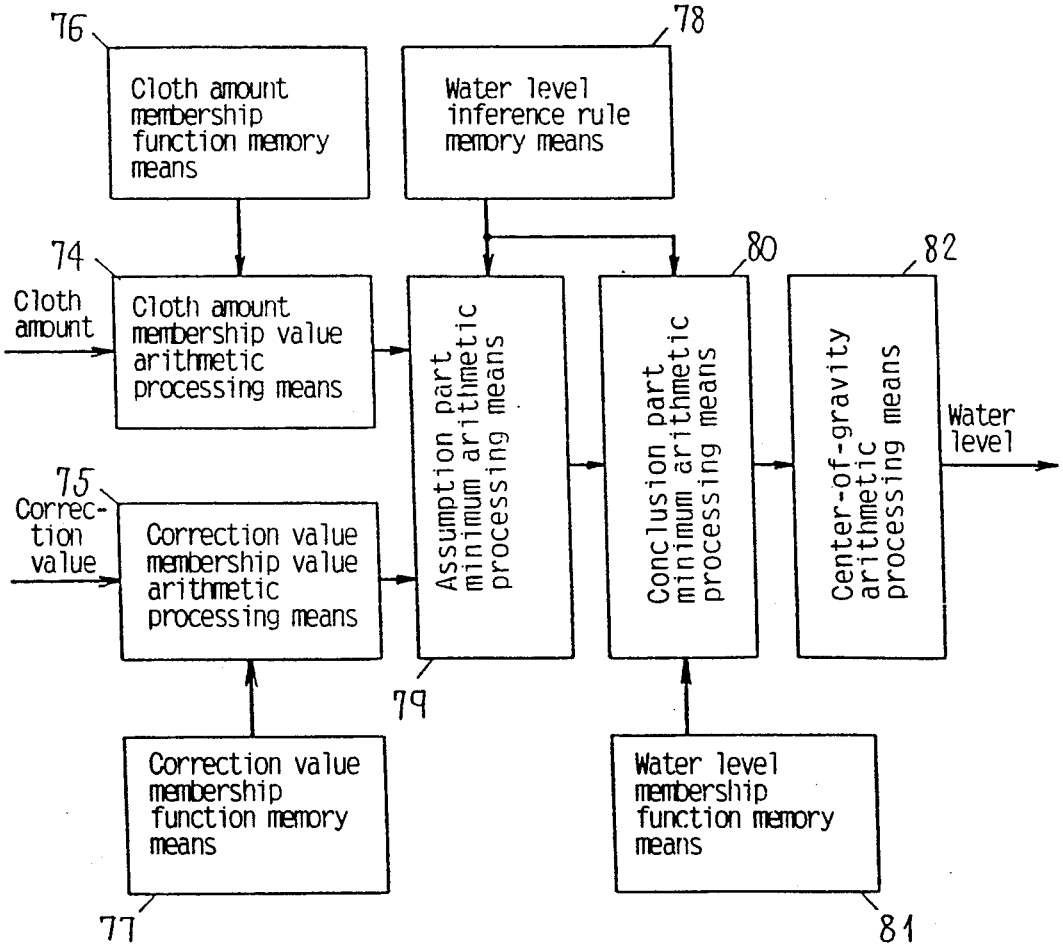
FIG. 38 is a block diagram of a fuzzy inference unit for determining the water level.

The fuzzy inference of the second step is done based on the general judgement such that "when the cloth amount is much and the correction value is fairly much, the water level is made very high". Rule of the inference comprises four individual rules shown in FIG. 35(*b*). Those qualitative concepts such that the cloth amount is "much", the correction value is "fairly much", or make the water level "high" are expressed quantitatively by membership functions likewise as in the first step. The fuzzy inference has a constitution as shown in FIG. 38, wherein a water level is obtained by a similar procedure as in the first step. The water level is adjusted in a manner that it becomes a water level determined by those two steps as described above in that a control section 62 controls a water supply valve 10 according to the detected value of the water level sensor 7.

Functions of the above-mentioned water level determination means 64 and the control art 62 can be easily realized by a micro-computer 63.

Figures 39, 40:
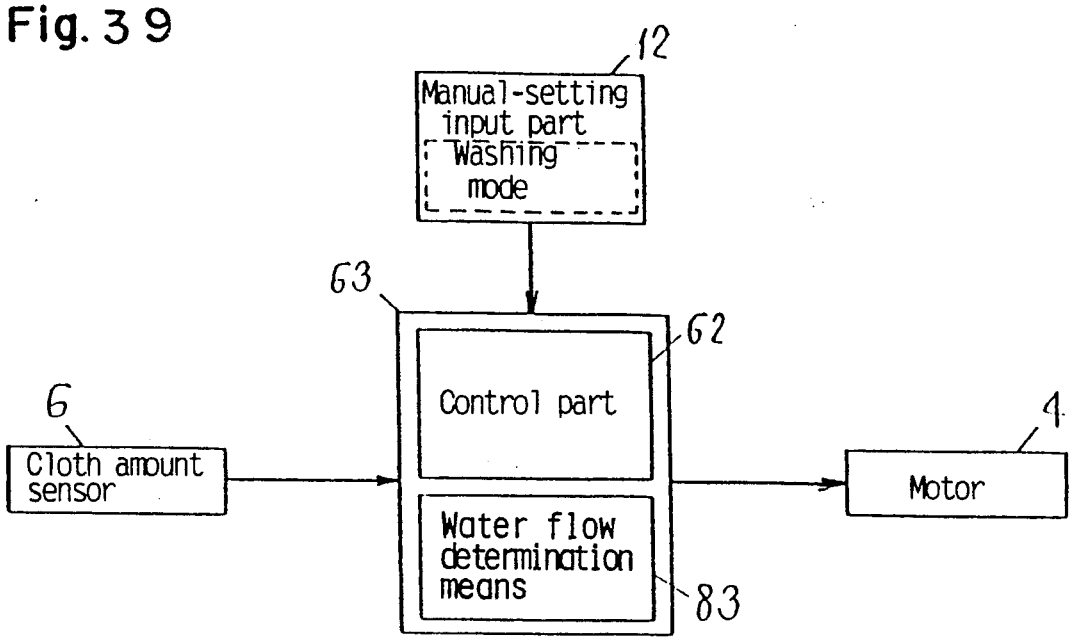
FIG. 39 is a block diagram of a second means in a washing machine of the fifth embodiment of the present invention.
FIG. 40 is a drawing showing a fuzzy inference rule for determining the water flow.
Figure 41A:
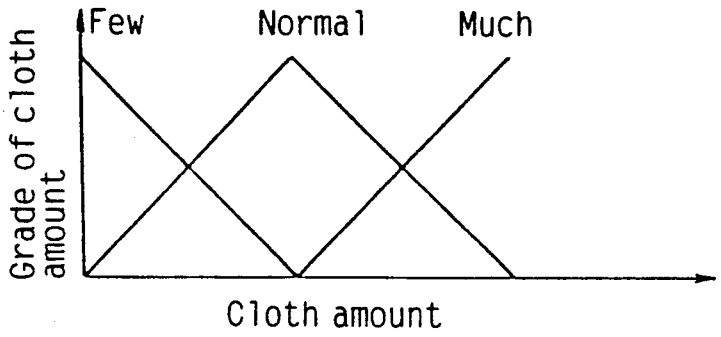
FIGS. 41(*a*) and 41(*b*) are graphs showing membership functions of the cloth amount and the mode of washing.
Figure 41B:
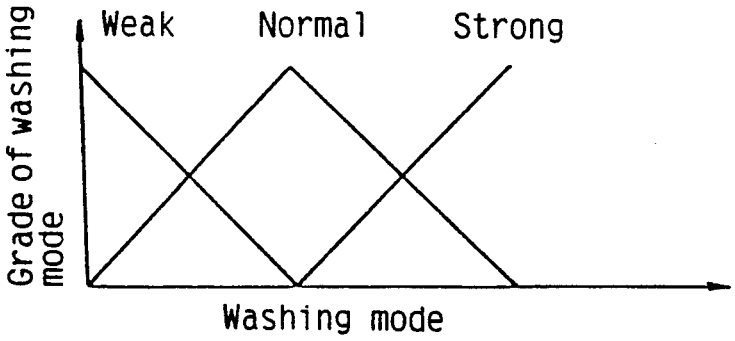
Figure 42:
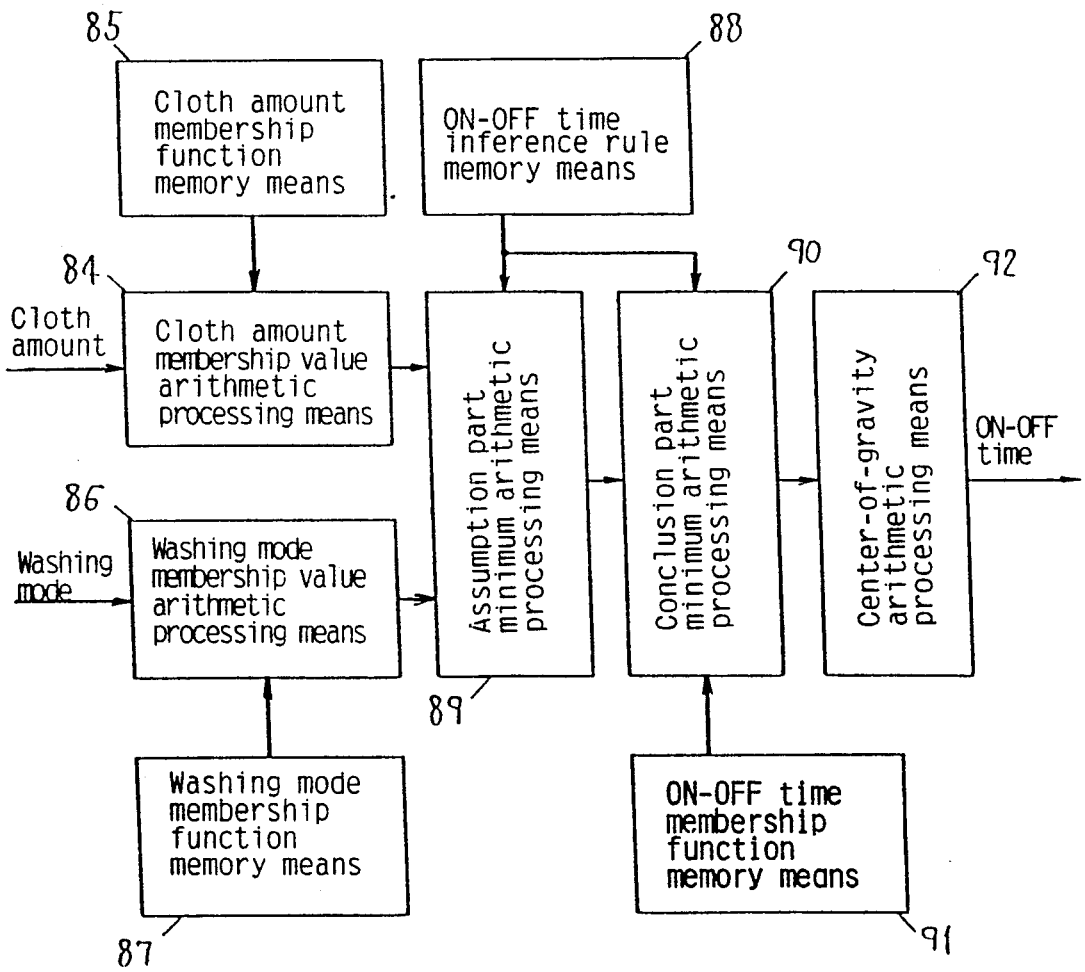
FIG. 42 is a block diagram of a fuzzy inference unit for determining the water flow.

Next, explanation is given on the determination of the water flow by as second means. FIG. 39 is one embodiment of the second means, the determination of the water flow is done by making a fuzzy inference in a water flow determination means 83 according to the input information of detected value from the cloth amount sensor 6 and the strength of the washing from the manual-setting input part 12. The fuzzy inference is done based on a general judgement such that "when the cloth amount is fairly much and the strength of the washing is fairly strong, the water flow is made very much". Rule of the inference comprises nine individual rules shown in FIG. 40. Those qualitative concepts such that the cloth amount is "much" or the strength of the washing is "fairly strong" are expressed quantitatively by membership functions as shown in FIGS. 41(*a*) and 41(*b*). Such the concept as "making the water flow strong" corresponds to an expression as "making ON-time long, and OFF-time short" on the motor 4, and these qualitative concepts such as making ON-time "long" or making OFF-time "short" are expressed quantitatively by membership functions likewise. The fuzzy inference has a constitution as shown in FIG. 42, wherein in a cloth amount membership value arithmetic processing means 84, a membership value of the detected value of the cloth amount sensor and the membership functions on the cloth amount is obtained by taking MAX of them. In a washing mode membership value arithmetic processing means 86, a membership value of the manual-setting input and membership function of the the washing mode is obtained similarly. In an assumption part minimum arithmetic processing means 89, the MIN between those above-mentioned two membership values is taken as a membership value for the assumption part. In a conclusion part minimum arithmetic processing means 90, the MIN between the assumption part membership value and the ON-OFF time membership function of the conclusion part is taken to be a conclusion of this rule.

After obtaining each conclusion on all of the rules, the MAX of all conclusions in a center-of-gravity arithmetic processing means 92 is used to determine, the ON-OFF time.

Those membership functions concerning the cloth amount, washing mode, and ON-OFF time are obtained by referring respectively to a cloth amount membership function memory means 85, a washing mode membership function memory means 87, and an ON-OFF time memory means 91. The inference rule is obtained by referring to an ON-OFF time inference rule memory means 88.

Water flow having an adequate strength can be obtained when the control part 62 switches ON and OFF the motor 4 based on the ON-OFF time of the motor determined by the inference explained above. The above-mentioned water flow determination means 83 and control part 62 can be easily realized by a microcomputer 63.

Figure 43:
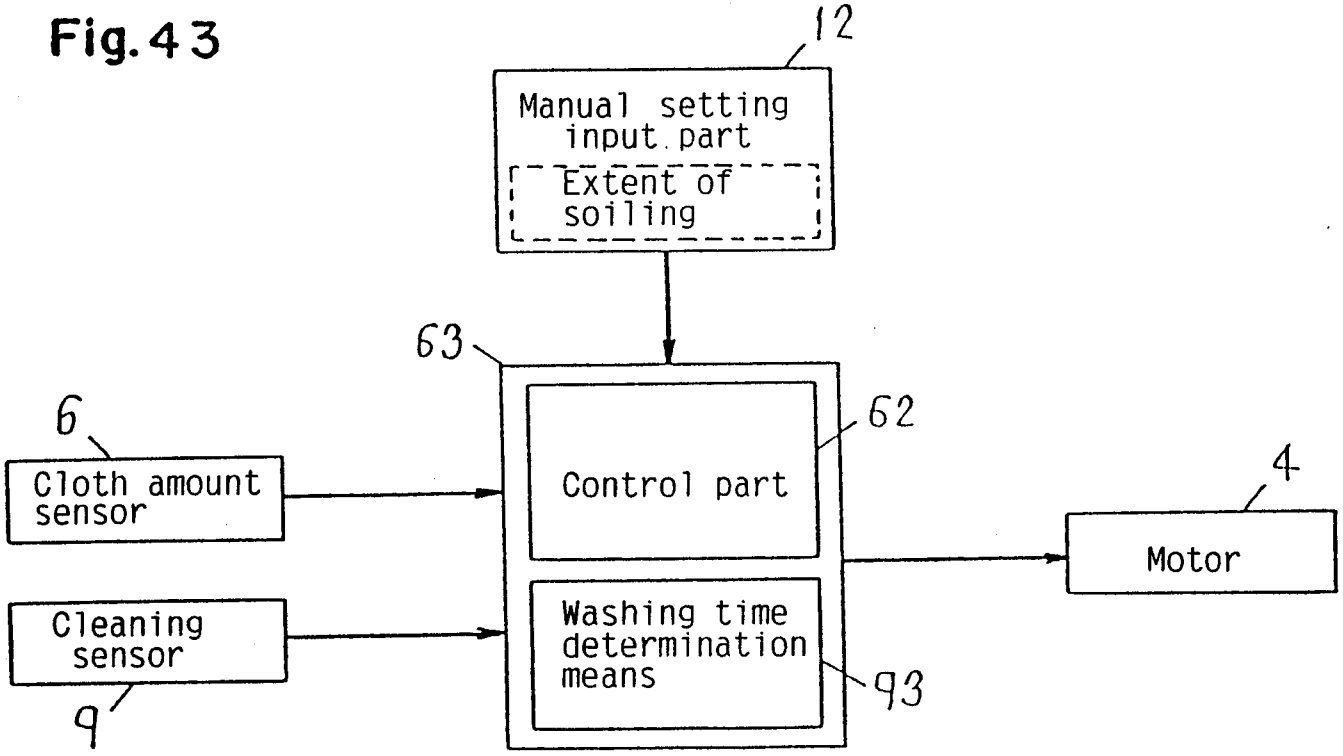
FIG. 43 is a block diagram of a third means in a washing machine of the fifth embodiment of the present invention.
Figure 45A:
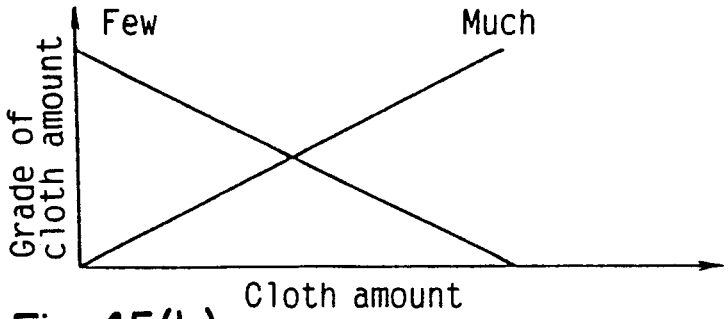
FIGS. 45(*a*), 45(*b*), 45(*c*), and 45(*d*) are graphs showing respectively membership functions of the laundry volume, light-transmittance, saturation time, and extent of soiling.
Figure 45B:
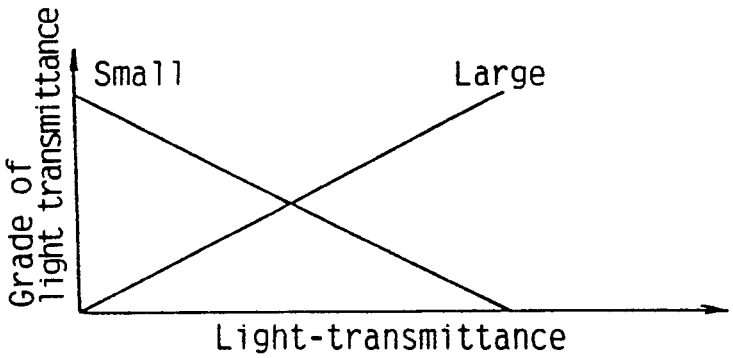
Figure 45C:
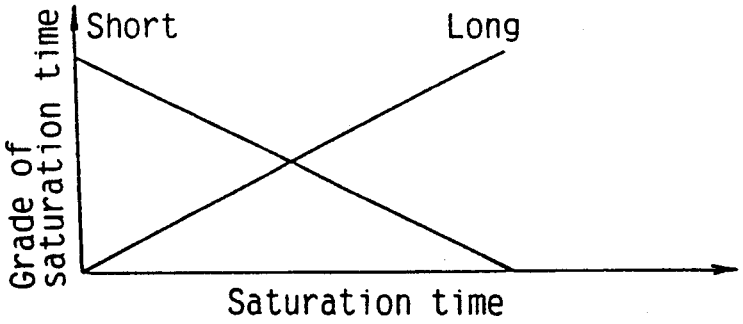
Figure 45D:
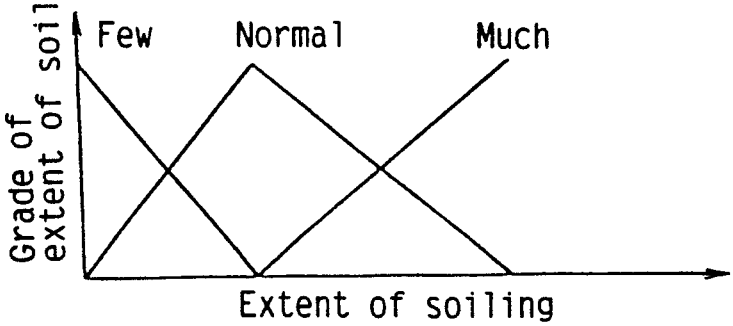

Next, explanation is given on the determination of the washing time by a third means. FIG. 43 is one embodiment of the third means, the determination of the washing time is done by making a fuzzy inference in a washing time determination means 93 according to the input information of detected value from the cloth amount sensor 6 and the cleaning sensor 9 and the degree of the extent of soiling from the manual-setting input part 12. Hereupon, the detected value of the cleaning sensor 9 gives two different informations, the time the light-transmission reaches its saturation and the light-transmittance at this time. The information is input to the washing time determination means.

Figure 46:
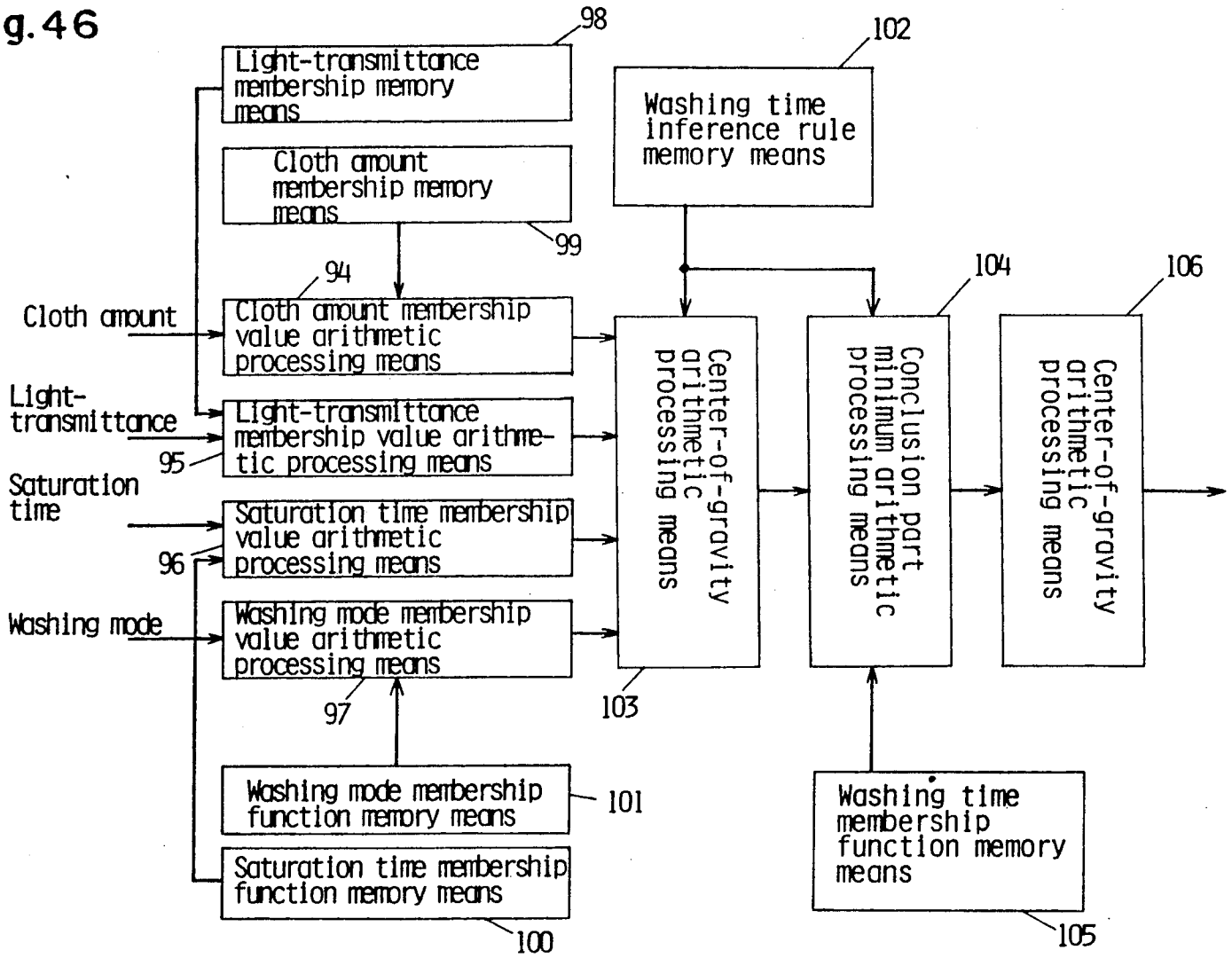
FIG. 46 is a block diagram of a fuzzy inference unit for determining the washing time.

The fuzzy inference is done based on a general judgement such that "when the cloth amount is much and the light-transmission is low, and the saturation time is long and the extent of soiling is much, the washing time is made very long". Rule of the inference comprises 24 individual rules shown in FIG. 44. Those qualitative concepts such that the cloth amount is "fairly much" or the extent of soiling is "much" are expressed quantitatively by membership functions as shown in FIGS. 45(*a*) to 45(*d*). The fuzzy inference has a constitution as shown in FIG. 46, wherein in a cloth amount membership value arithmetic processing means, 94, a membership value of the detected value of the cloth amount sensor and the membership functions on the cloth amount is obtained by the MAX of them. In a washing mode membership value arithmetic processing means 97, a membership value of the manual-setting input and the membership function on the the washing mode is obtained similarly. Also similarly, in a light-transmission membership value arithmetic processing means 95 or in the saturation time membership value arithmetic processing means 96, required membership values are obtained. In the assumption part minimum arithmetic processing means 103, the MIN among the above-mentioned four membership values is taken as a membership value for the assumption part. In a conclusion part minimum arithmetic processing means 104, the MIN between the assumption part membership value and the washing time membership function of the conclusion part is taken to be a conclusion of this rule.

After obtaining each conclusion on all of the rules, the MAX of all conclusions in a center-of-gravity arithmetic processing means 106 is used to determine the washing time.

Those membership functions concerning the cloth amount, washing mode, light-transmission/saturation time, and washing time are obtained by referring respectively to a cloth amount membership function memory means 99, a washing mode membership function memory means 101, a light-transmission membership function memory means 98, a saturation time membership function memory means 100, and the washing time membership function memory means 105. The inference rule is obtained by referring to an washing time inference rule memory means 102.

The control of the motor 4 is carried out in the control part 62 based on the washing time determined by the fuzzy inference explained above, thereby the motor is turned OFF after a determined time. The above-mentioned washing time determination means 93 and control part 62 can be easily realized by a micro-computer 63.

Figure 47:
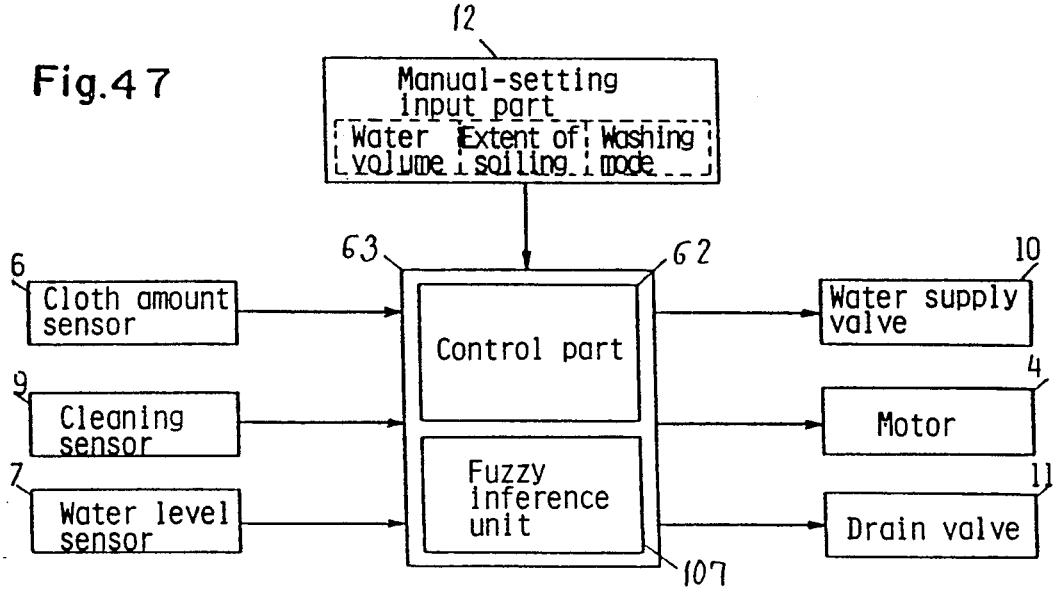
FIG. 47 is a block diagram of a fourth means in a washing machine of the fifth embodiment of the present invention.
Figure 48:
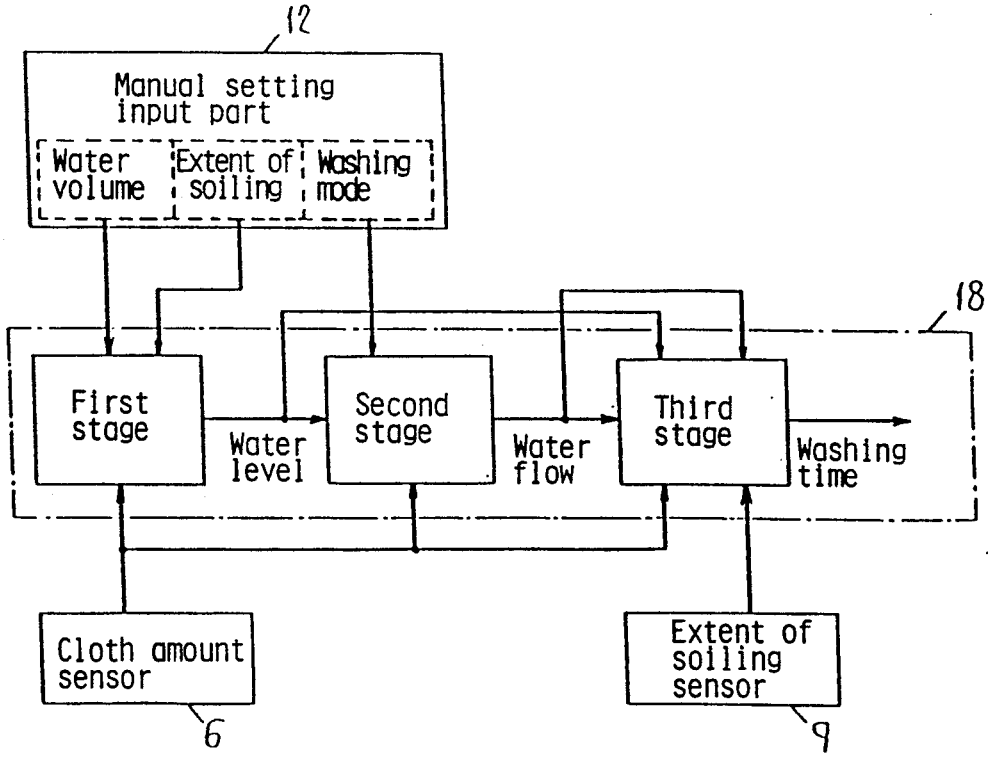
FIG. 48 is a block diagram showing an actual constitution of a fuzzy inference.
Figure 50:
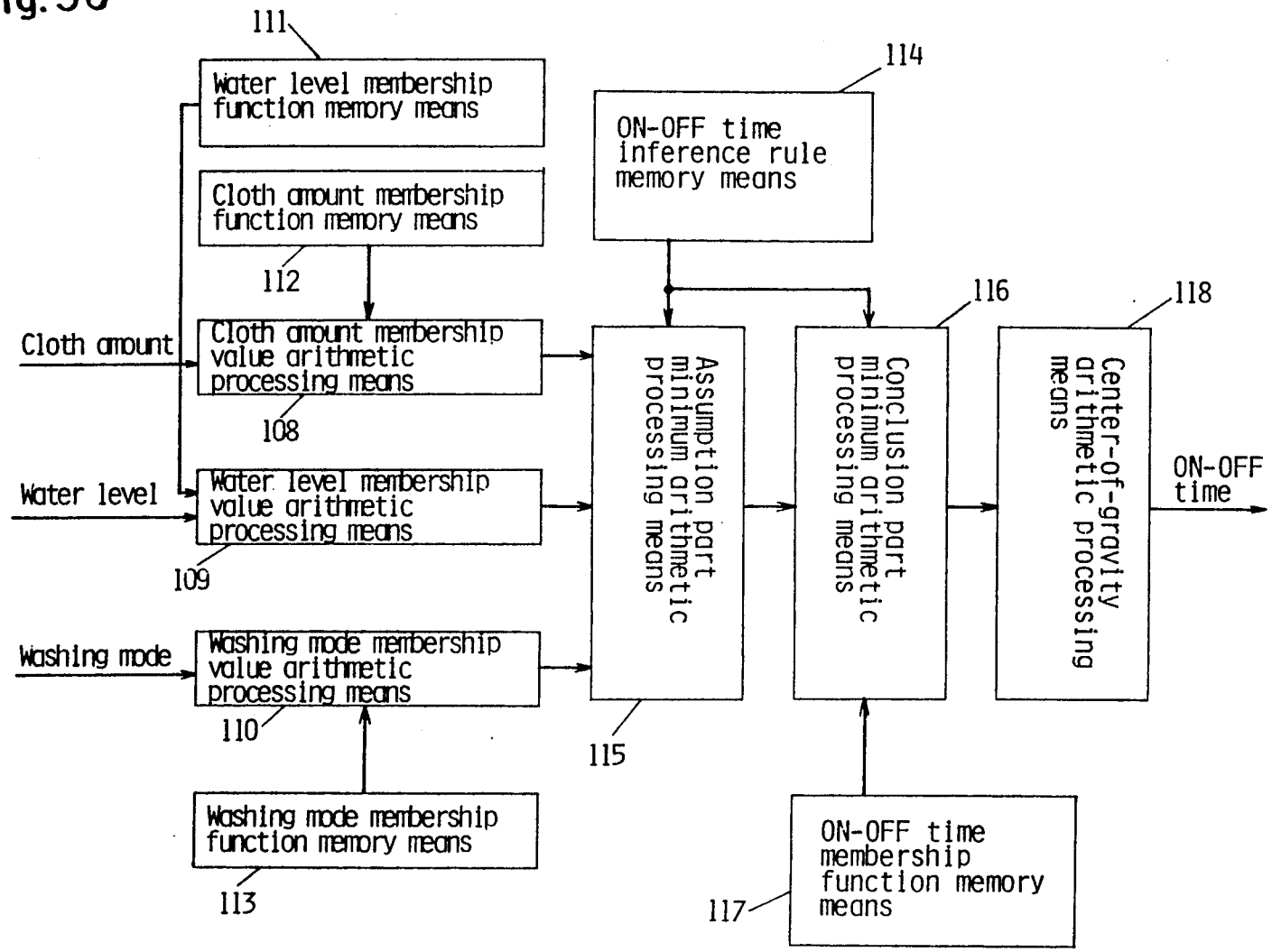
FIG. 50 is a block diagram of a fuzzy inference unit for determining the water flow.
Figure 51:
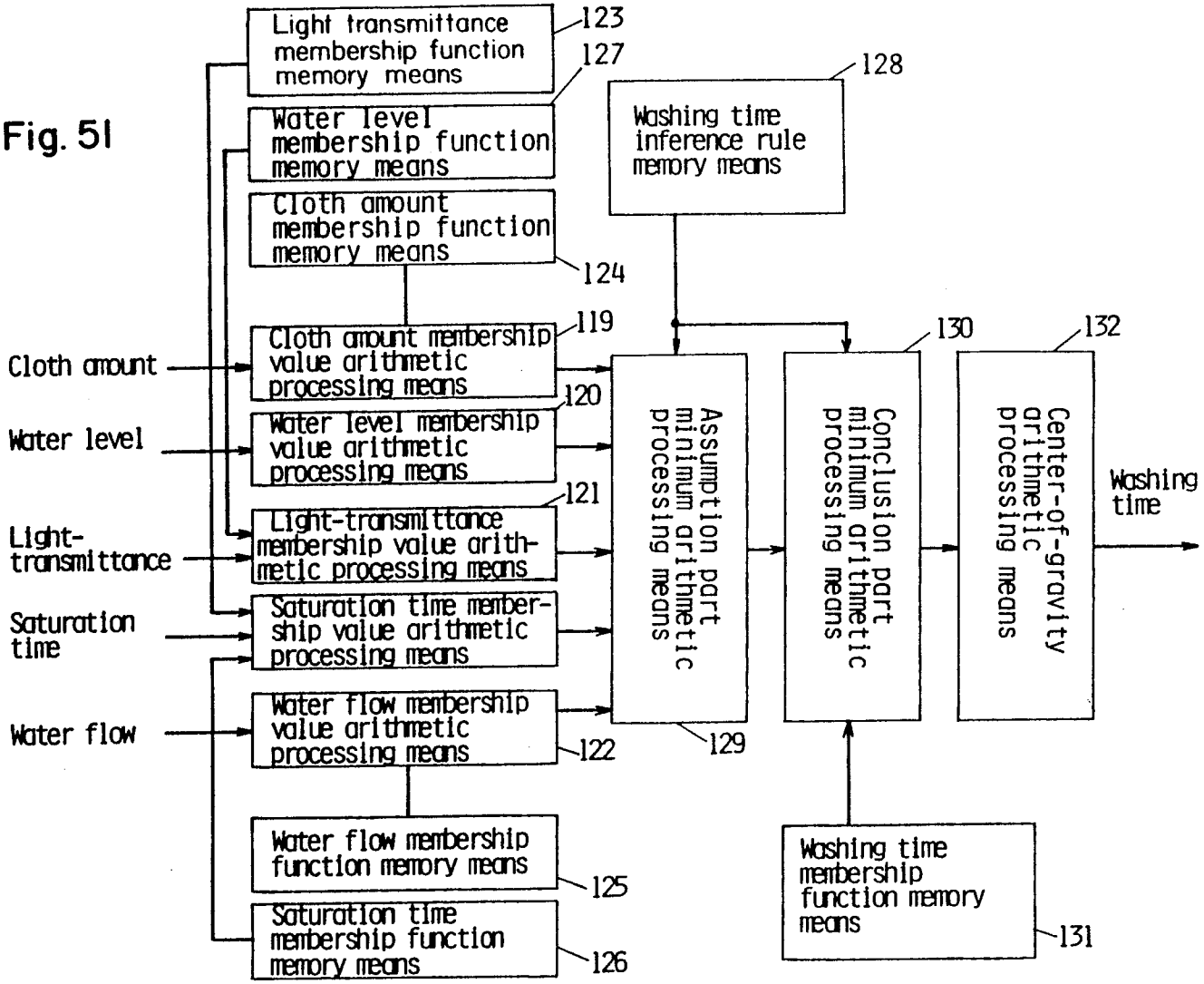
FIG. 51 is a fuzzy inference unit for determining the washing time.

Next, explanation is given on the determination of various washing conditions by a fourth means. FIG. 47 is one embodiment of the fourth means, the determination of various washing conditions is done by making a fuzzy inference in a washing time determination means 107 according to the input information of detected value from the cloth amount sensor 6 and the cleaning sensor 9 and the degree of the water volume, the degree of the extent of soiling, and the strength of the washing from the manual-setting input part 12. The fuzzy inference comprises multiple-stage inference of three stages as shown in FIG. 48.

A first stage is to determine an adequate water level similarly as in the embodiment of the above-mentioned first means. A second stage is to determine the water flow by means of fuzzy inference using information of the strength of the washing from the manual-setting input part, the detected value of the cloth amount sensor, and the water level determined by the first stage. The fuzzy inference is such that "when the cloth amount is fairly much and the water level is fairly high, and the washing mode is fairly strong, the water flow is made strong", which comprises 12 rules shown in FIG. 49. The fuzzy inference has a constitution shown in FIG. 50, wherein in a cloth amount membership value arithmetic processing means 108 a membership value of the detected value of the cloth amount sensor and the membership functions on the cloth amount is obtained by taking MAX of them. In a washing mode membership value arithmetic processing means 110, a membership value of the manual-setting input and the membership function on the the washing mode is obtained similarly. Also similarly, in a water level membership value arithmetic processing means 109, a desired membership value is obtained. In an assumption part minimum arithmetic processing means 115, the MIN of the above-mentioned three membership values is taken as a membership value for the assumption part. In a conclusion part minimum arithmetic processing means 116, the MIN between the assumption part membership value and the ON-OFF time membership function of the conclusion part is taken to be a conclusion of this rule.

After obtaining each conclusion on all of the rules, the MAX of all conclusions in a center-of-gravity arithmetic processing means 118 is used to determine the ON-OFF time.

Those membership functions concerning the cloth mount, washing mode, water level, and ON-OFF time are obtained by referring respectively to a cloth amount membership function memory means 112, a washing mode membership function memory means 113, a water level membership function memory means 111, and an ON-OFF time membership function memory means 117. And the inference rule is obtained by referring to an ON-OFF time inference rule memory means 114.

A third stage is to determine the washing time by means of fuzzy inference using the detected value of the cloth amount sensor 6 and the cleaning sensor 9, the water level determined by the first stage, and the water flow determined by the second stage. Hereupon, the detected value of the cleaning sensor 9 gives two different informations, the time the light-transmission reaches its saturation and the light-transmittance at this time. This information the input for the fuzzy inference unit 107. The fuzzy inference is such that "when the cloth amount is much and the water level is fairly high, and the water flow is fairly strong, the saturation time is long, and the light-transmission is small, the washing time is made very long", which comprises 32 rules. The fuzzy inference has a constitution shown in FIG. 51, and the washing time is obtained by a similar procedure as the above-mentioned second stage.

Responding to the result of three stages explained above, water supply control, water flow control, and washing time control are carried out by that the control part 62 controls the water supply valve 9 and the motor 4. The above-mentioned fuzzy inference unit 107 and control part 62 can be easily realized by a micro-computer 63.

Hereupon, by providing a manual-setting input part concerning the sort of cleaning material and the hardness of water, a further finer determination of the washing condition including temperature control, cleaning material control and others can be attained.

INDUSTRIAL APPLICABILITY

As has been described above in accordance with the present invention, by letting a washing time inference unit have the known-how by which the washing time is determined from the degree of soiling, the washing time is determined after adding various factors as a user generally does. Thus, a most suitable washing time can obtained, enabling the realization of a more careful washing.

A most suitable washing water flow and rinse water flow can be obtained by taking into account the soiling, into the cloth amount and the damage of cloth into using a water flow inference unit; which has cloth amount, degree of the soiling, washing time, and rinse time as its inputs. This is possible because it is not difficult to give the water flow inference unit the know-how of the water flow control that we usually know from our experience.

Since the amount of the laundry is detected not only from the water level sensor but also from the water level increasing rate, the water level at the time of washing as well as at the time of rinse can be determined by a multi-dimensional information of weight and volume of the. Thereby a careful washing and rinse, responding to the quantity and the quality of the laundry, can be attained.

By, providing, besides the detected values from various sensors, to the washing condition inference unit to which, information from the manual-setting input part can be input. The determination of various washing conditions that account simultaneously for the multi-dimensional information, such as the information concerning the sort and the quantity of the laundry and the detected value from the cloth amount sensor and the soiling sensor, is carried out by the fuzzy inference. Responding to this determined washing condition, the control part controls the motor, water supply valve, and drain valve, thereby a careful and adequate washing can be realized. The fuzzy inference unit can easily be designed by letting it have the know-how that we know from our experience.

The manual-setting input part which accepts the manual input by the operator concerning the water volume and the extent of soiling, and the water level determination means, which determines the water level by both of the information obtained from the manual-setting input part and the detected value of the cloth amount sensor, make it possible to determine the water level according to the operator's taste within a range of the adequate water level determined by the detected value of the cloth amount sensor. That is, the determination of the water level taking the operator's subjective point of view into account becomes possible.

The manual-setting input part, which accepts the manual input by the operator concerning the washing mode, and the water flow determination means, which determines the water flow by both of the information obtained from the manual-setting input part and the detected value of the cloth amount sensor, make it possible to determine the water flow according to the operator's taste within a range of the adequate water flow determined by the detected value of the cloth amount sensor. That is, the determination of the water flow taking the operator's subjective point of view into account becomes possible.

The manual-setting input part, which accepts the manual input by the operator concerning the water volume and the extent of soiling, and the washing time determination means, which determines the washing time and the rinse time by both of the information obtained from the manual-setting input part and the detected value of the cleaning sensor, make it possible to determine the water flow according to the operator's taste within a range of the adequate washing time determined by the detected value of the cleaning sensor. That is, the determination of the washing time taking the operator's subjective point of view into account becomes possible. furthermore, the a fuzzy inference unit making the multiple stage determination on various washing conditions concerning the adequate water level, the washing water flow and rinse water flow, and washing time, and a manual-setting setting input part, which accepts the manual input by the operator concerning the water volume, the extent of soiling and the washing mode, makes it possible to determine various washing conditions according to the operator's taste within a range of the adequate various conditions. That is, the determination of various washing conditions taking the operator's subjective point of view into account becomes possible. By making a multiple stage inference, it becomes possible to determine more carefully various washing conditions.

What is claimed is:

1. A washing machine controller for controlling a washing machine comprising:

a cleaning sensor for detecting turbidity of water in a washing tub during a washing operation of the washing machine;

time measurement means for measuring a saturation time period from a start of a washing operation to a time point of saturation, the time point of saturation determined when the detected turbidity saturates;

washing time inference means using a fuzzy inference operation for making an inference as to an amount of additional washing time necessary for the cleaning operation after the time point of saturation based on the saturation time period and the detected turbidity; and control means for stopping the washing operation when the amount of additional washing time expires.

2. A washing machine controller according to claim 1, wherein the cleaning sensor comprises a light-emitting part and a light-receiving part.

3. A washing machine controller according to claim 1, wherein the washing time inference means comprises:

a saturation time membership value determining means for determining a saturation membership value of the saturation time period based on the saturation time period and a saturation time membership function;

a turbidity membership value determining means for determining a turbidity membership value of the detected turbidity based on the detected turbidity and a detected turbidity membership function;

an assumption part determining means for determining assumption part membership values based on the saturation membership value, the turbidity membership value, and a set of washing time inference rules;

a conclusion part determining means for determining conclusions for the set of washing time inference rules based on the set of washing time inference rules, the assumption part membership values and a washing time membership function; and an additional washing time determining means for determining the amount of additional washing time based on the conclusions.

4. A washing machine controller according to claim 3, wherein the assumption part determining means compares, based on each washing time inference rule, the saturation membership value and the turbidity membership value and takes a minimum of the saturation membership value and the turbidity membership value as a assumption part membership value.

5. A washing time controller according to claim 3, wherein the additional washing time means determines a center of gravity of the conclusions, and a washing time at the center of gravity of the conclusions is determined as the amount of additional washing time.

6. A washing time controller according to claim 3, further comprising a saturation time membership function memory means, a turbidity membership function memory means, a washing time membership function memory mens, and an inference rule memory means for storing the saturation time membership function, the turbidity membership function, the washing time membership function, and the set of washing time inference rules, respectively.

7. A washing machine controller according to claim 3, wherein the turbidity membership function comprises a weighted monotonous type membership function.

* * * * *